US006554412B1

(12) United States Patent
Seino et al.

(10) Patent No.: US 6,554,412 B1
(45) Date of Patent: Apr. 29, 2003

(54) INK CARTRIDGE, INK JET RECORDER, AND METHOD OF MOUNTING INK CARTRIDGE

(75) Inventors: Takeo Seino, Nagano (JP); Takahiro Naka, Nagano (JP); Satoshi Shinada, Nagano (JP); Koichi Toba, Nagano (JP); Hisashi Koike, Nagano (JP); Yasuhiko Kamijo, Nagano (JP); Tomio Yokoyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/684,789

(22) Filed: Oct. 10, 2000

(30) Foreign Application Priority Data

| | | |
|---|---|---|
| Oct. 8, 1999 | (JP) | 11-287629 |
| Nov. 8, 1999 | (JP) | 11-317450 |
| Sep. 29, 2000 | (JP) | 2000-299196 |

(51) Int. Cl.[7] ..... B41J 2/175
(52) U.S. Cl. ..... 347/86; 347/85
(58) Field of Search ..... 347/84, 85, 86, 347/87; 141/309; 401/107

(56) References Cited

U.S. PATENT DOCUMENTS

| | | | | | |
|---|---|---|---|---|---|
| 3,941,171 | A | * | 3/1976 | Ogle | 141/309 |
| 5,657,058 | A | * | 8/1997 | Mochizuki et al. | 347/7 |
| 5,734,401 | A | * | 3/1998 | Clark et al. | 347/86 |
| 5,754,207 | A | | 5/1998 | Gragg et al. | 347/86 |
| 5,875,615 | A | * | 3/1999 | Ito et al. | 53/474 |
| 6,033,141 | A | * | 3/2000 | Blaustein et al. | 401/107 |

FOREIGN PATENT DOCUMENTS

| | | | |
|---|---|---|---|
| EP | 0 498 117 A2 | 8/1992 | B41J/2/175 |
| EP | 0 585 615 A2 | 3/1994 | B41J/2/175 |
| EP | 0 627 317 A1 | 12/1994 | B41J/2/175 |
| EP | 0 709 207 A2 | 5/1996 | B41J/2/175 |
| EP | 0 761 450 A2 | 3/1997 | B41J/2/175 |
| EP | 0 778 145 A1 | 6/1997 | B41J/2/175 |
| EP | 0 847 866 A2 | 6/1998 | B41J/25/34 |
| EP | 0 861 733 A2 | 9/1998 | B41J/2/175 |
| GB | 2 279 041 A | 12/1994 | B41J/23/02 |
| GB | 2 315 461 A | 2/1998 | B41J/2/175 |
| JP | 50-74341 | 6/1975 | |
| JP | 63-9546 | 1/1988 | B41J/3/04 |
| JP | 63-11343 | 1/1988 | B41J/3/04 |
| JP | 5-229137 | 9/1993 | B41J/2/175 |
| JP | 9-174876 | 7/1997 | B41J/2/175 |

* cited by examiner

*Primary Examiner*—Anh T. N. Vo
(74) *Attorney, Agent, or Firm*—Sughrue Mion, PLLC

(57) ABSTRACT

An ink supply port is sealed with a seal material made up of two layers of at least a physical protective layer and an airtight hold layer and formed with slits in the physical protective layer. When ink cartridge is mounted, a tip of an ink introduction member breaks the seal material sealing the ink supply port along the slits made in the seal member, and air is released to the atmosphere without raising pressure of a space of packing. Then, the ink introduction member penetrates the packing.

46 Claims, 21 Drawing Sheets

INK CARTRIDGE, INK JET RECORDER, AND METHOD OF MOUNTING INK CARTRIDGE

BACKGROUND OF THE INVENTION

This invention relates to a detachable ink cartridge for supplying ink to a record head for ejecting ink droplets in response to a print signal, an ink jet recorder that can be replenished with ink from the ink cartridge, and a method of mounting the ink cartridge.

A record head of an ink jet recorder is connected to an ink cartridge via an ink supply flow passage for receiving supply of ink from the ink cartridge. To make it possible to replenish with ink, the ink cartridge is provided with an ink supply port and the ink supply flow passage is provided with a hollow needle, so that when the ink cartridge is loaded, the hollow needle is inserted into and joined to the ink supply port.

The ink supply port of the ink cartridge is sealed with a film through which an ink introduction member can be inserted, in order to prevent ink from leaking out during distribution, etc.

On the other hand, an ink cartridge capable of changing ink to ink optimal to a record medium by ink exchange is provided with valve means at the upper end of an ink supply port, namely, on the side of an ink storage area, as disclosed in JP-A-5-229137 and JP-A-9-174876. The valve means is opened by inserting an ink introduction member.

The ink cartridge of this type involves a possibility that air will flow in or ink will leak out through a valve part in the assembling step of the ink cartridge, during the transport and storage thereof, etc., because of a slight dimension error of the components constituting the valve means, a surface depression, or deposition of small dust on the valve part. Particularly, the possibility is raised when the inside of an ink chamber is placed in a reduced pressure state lower than the atmospheric pressure or when the ink cartridge is packed in a reduced pressure state. Vibration, drop, temperature change, etc., during the transport of the ink cartridge can also cause air to flow in or ink to leak out.

Therefore, the ink support port is sealed with a seal material made of a film having a strength to such an extent that an ink introduction member for supplying ink from the ink cartridge to a record head, for example, a hollow needle with a sharp tip, can be inserted, thereby preventing air from entering the ink cartridge or ink from leaking out.

This, however, causes another problem. As shown in FIG. 26, when a seal material 101 is pressed by an ink introduction member 100 in conjunction with the mounting of the ink cartridge, air in a closed space 102 is compressed by the deformed seal material 101. At the instant at which the ink introduction member 100 is further pushed and penetrates the seal material 101, air flow A compressed in the space 102 passes through an ink introduction port 103 (needle hole) and flows into the record head, degrading the print quality and hindering ink droplets from the record head.

SUMMARY OF THE INVENTION

It is therefore a first object of the invention to provide an ink cartridge capable of preventing air from entering a record head when the ink cartridge is mounted while preventing entry of air and ink leakage.

It is a second object of the invention to provide an ink jet recorder capable of preventing air from entering a record head as much as possible when the ink cartridge is placed.

It is a third object of the invention to propose a method of mounting the above-mentioned ink cartridge.

To the end, according to the invention, there is provided an ink cartridge comprising a container for storing ink, an ink supply port into which an ink introduction member communicating with a record head is to be inserted, and an ink passage open/close section opened and closed as the ink introduction member is advanced and retreated, wherein the ink supply port is sealed with a seal material, and a breakage induction part is provided to the seal material or a vicinity of the ink supply port.

When the ink cartridge is mounted, the ink introduction member abuts the seal member and further is pushed in to the preceding stage of entering fluid-sealing relation. At the time, the seal material is broken with the breakage induction part as a base point, so that air in the space between the ink passage open/close section and the seal material is released to the atmosphere. Then, the ink introduction member is inserted into the ink supply port in fluid-sealing relation. Accordingly, air is prevented from entering the record head.

The present disclosure relates to the subject matter contained in Japanese patent application Nos. Hei. 11-287629 (filed on Oct. 8, 2000), Hei. 11-317450 (filed on Nov. 8, 1999), and 2000-299196 (filed on Sep. 29, 2000), which are expressly incorporated herein by reference in their entireties.

DESCRIPTION OF THE PREFERRED EMBODIMENT

Referring now to the accompanying drawings, there are shown preferred embodiments of the invention.

Figure 1B:
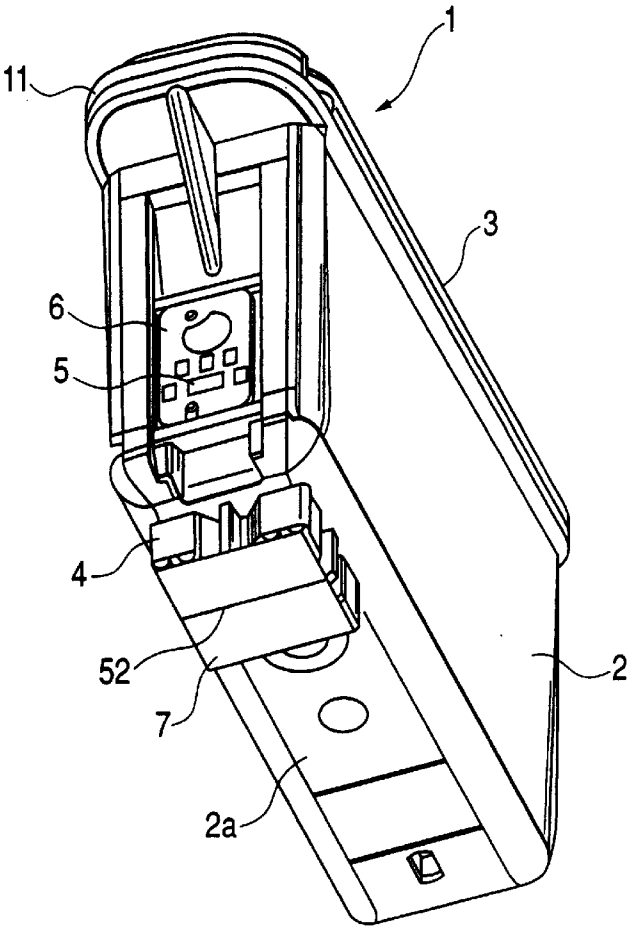
FIGS. 1A and 1B are drawings to respectively show the top structure and the bottom structure of one embodiment of a black ink cartridge of the invention.
Figure 1A:
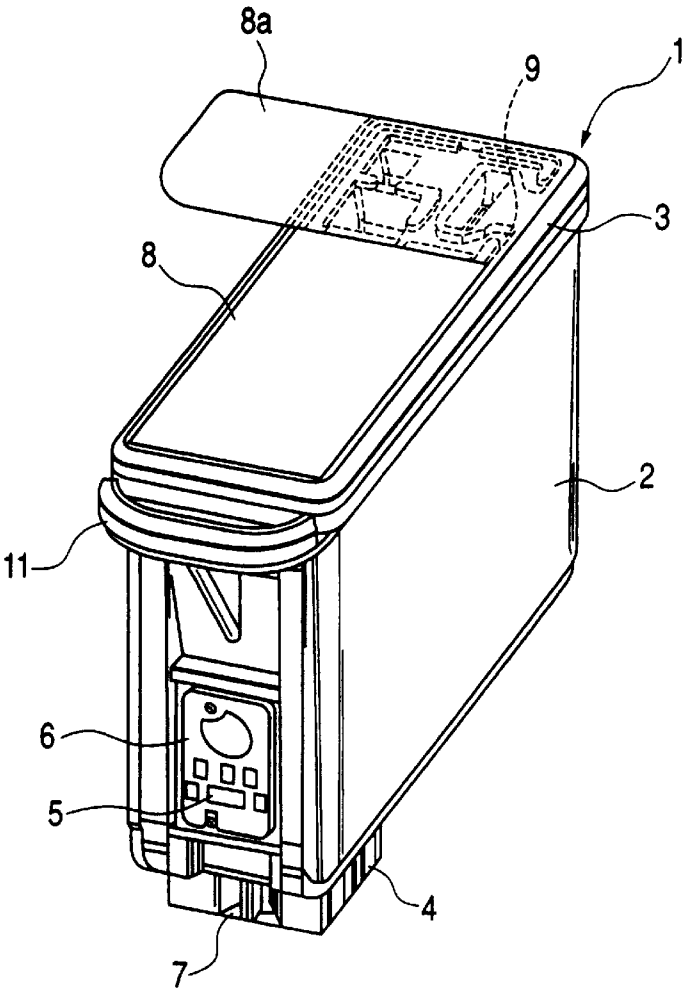

FIG. 1 shows an embodiment of an ink cartridge of the invention by taking a black ink cartridge as an example. A cartridge 1 is shaped almost like a rectangular parallelepiped, and is made up of a container main unit 2 forming an ink chamber 10 and a lid 3 for sealing an opening of the container main unit 2. An ink supply port 4 engaging an ink introduction part communicating with a record head is formed in one side (a lower face 2*a*, in the embodiment) of the container main unit 2.

A circuit board 6 is fixed onto a face of the container main unit 2 in the proximity of the ink supply port 4. The circuit board 6 is formed on a surface with an electrode 5 for connection to the outside and is provided on a rear with storage means.

The storage means stores information for identifying the ink cartridge 1, for example, the manufacturing serial number, manufacturing date (for example, year, month and day), ink amount, etc.

A seal material 7 for sealing is put on the ink supply port 4 to prevent air from entering the cartridge 1 and ink from leaking to the outside until the user starts to use the cartridge 1 after factory shipment.

On the other hand, films 8 and 8*a* are put on the lid 3 for sealing an ink injection port and a ventilation hole.

Figure 2A:
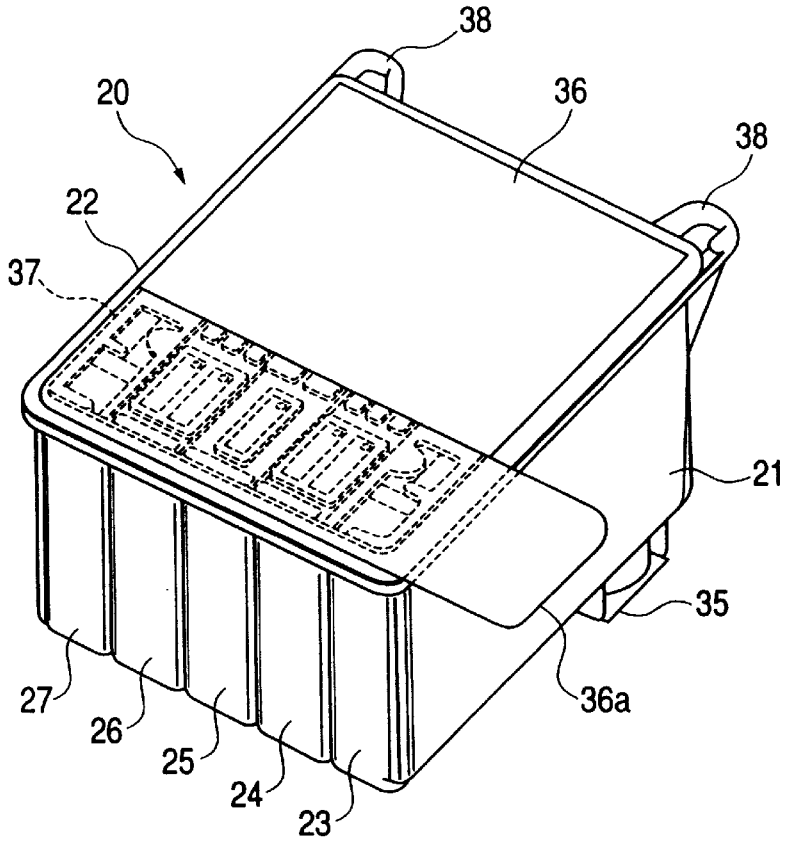
FIGS. 2A and 2B are drawings to respectively show the top structure and the bottom structure of one embodiment of a color ink cartridge of the invention.

FIG. 2 shows an embodiment in which the ink cartridge of the invention is applied to to a color ink cartridge 20. The cartridge 20 is shaped almost like a rectangular parallelepiped similarly to the black ink cartridge, and is made up of a container main unit 21 formed with a plurality of ink chambers and a lid 22 for sealing an opening of the container main unit 21. The container main unit 21 is divided into a plurality of ink chambers (in this embodiment, five ink chambers 23 to 27) by partitions, and ink supply ports (28 to 32) engaging ink introduction parts communicating with a record head are formed in a lower face 21*a* to communicate with the ink chambers (23 to 27), respectively.

A circuit board 34 is fixed on to another face in the proximity of the face where the ink supply ports 28 to 32 are formed. The circuit board 34 is formed on a surface with an electrode 33 for connection to the outside, and is provided on a rear with storage means. The storage means stores information for identifying the ink cartridge 20, for example, the manufacturing serial number, the manufacturing date (for example, year, month and day), the ink amounts of the ink chambers, etc.

In the figures, numerals 38 and 38 denote projections for aiding in attaching and detaching the ink cartridge to and from a cartridge holder of a recorder.

A seal material 35 for sealing is put on the ink supply ports 28 to 32 to prevent air from entering the cartridge 20 and ink from leaking to the outside until the user starts to use the cartridge 20 after factory shipment. On the other hand, films 36 and 36*a* are put on the lid 22 for sealing ink injection ports and ventilation holes.

Figure 3A:
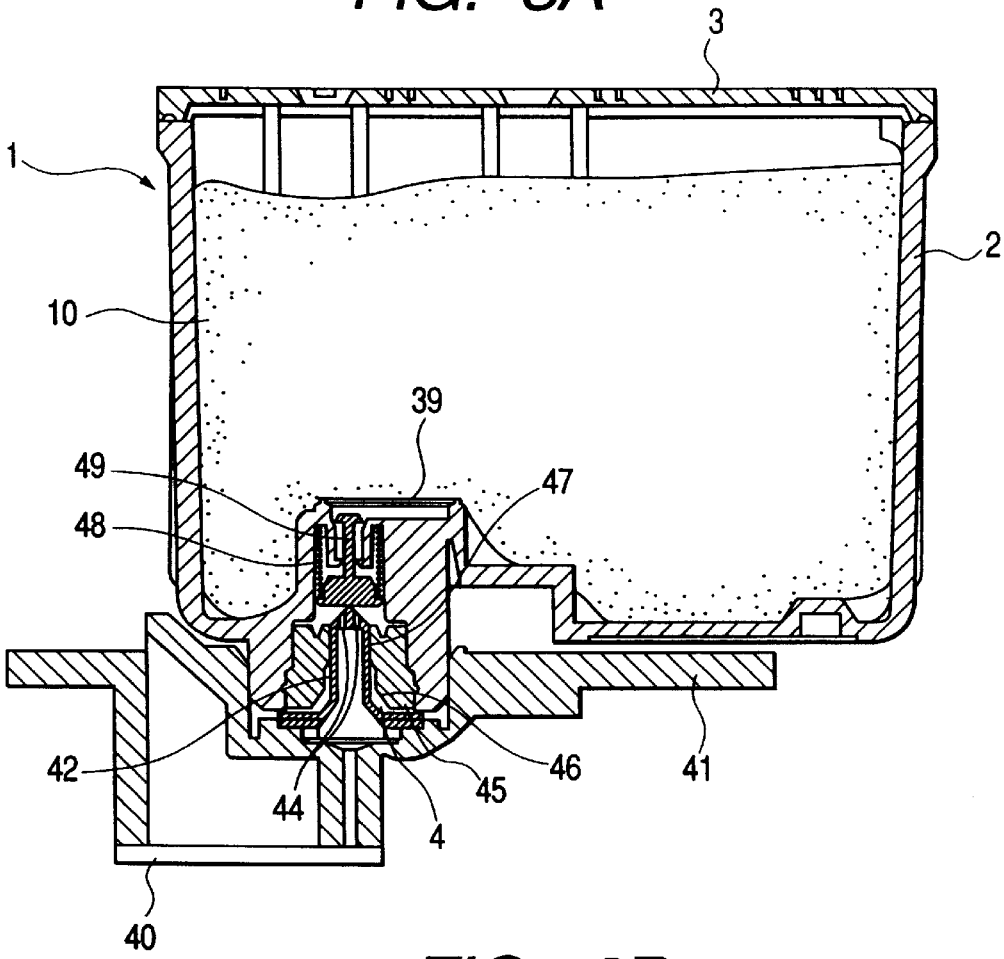
FIGS. 3A and 3B are drawings to respectively show the cross-sectional structure of the black ink cartridge taken as an example, and the structure of a vicinity of an ink supply port in an enlarged manner.

FIG. 3A is a drawing to show the sectional structure of the black ink cartridge taken as an example. The ink chamber 10 stores a porous member impregnated with ink so that required negative pressure is given to ink. A filter 39 is placed between the ink chamber 10 and the ink supply port 4 so as to come in contact with the porous member. The seal material 7 is put on the outer end of the ink supply port 4 for sealing the ink supply port 4. A closed space 60 is formed between a valve body 49 and the seal material 7.

On the other hand, a record head 40 is fixed to a carriage 41 of an ink jet recorder to which the ink cartridge is mounted, and an ink introduction member 42 is set so as to protrude on the carriage 41 and communicate with the record head 40. When the ink cartridge 1 is mounted on a predetermined position of the carriage 41, the ink introduction member 42 penetrates the seal material 7 and is joined to packing 45 in fluid-sealing relation to allow the ink chamber 10 and the record head 40 to communicate with each other.

The ink introduction member 42 is formed as a tubular member, and has a taper part at its tip portion. Through holes for allowing ink to flow in, namely, ink introduction ports 44, 44, . . . are formed in the taper part. The tip end of the ink introduction member 42 is contoured to have a proper sharp pointed shape so that tension can be given to the seal material 7 for-breaking the seal material 7 when the seal material 7 on the ink supply port is pressed by the tip end.

Figure 3B:
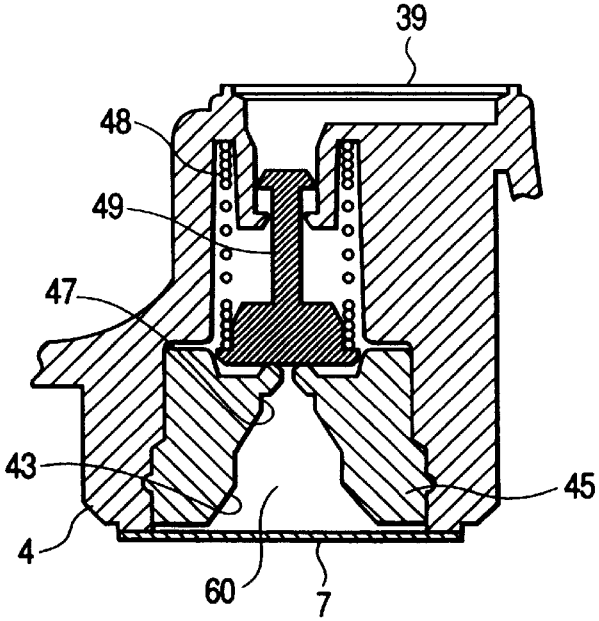

As shown in FIG. 3B, the packing 45 is formed at its inner peripheral surface with a taper part 43, and at its tip, i.e. the ink chamber side thereof, with a cylindrical fit part 47. With this arrangement, the tip area of the ink introduction member 42 is guided by the taper part 43 until the fit part 47 is brought into tight contact with the ink introduction member 42 to secure the fluid-sealing relation.

The valve body 49 is constantly pressed against the top of the packing 45 by the force of a spring 48 so as to close an ink flow passage. When the ink introduction member 42 is inserted up to a predetermined position, that is, after the fit part 47 is brought into tight contact with the ink introduction member 42 to secure the fluid-sealing relation, the valve body 49 is pushed up to open the flow passage.

Figure 4A:
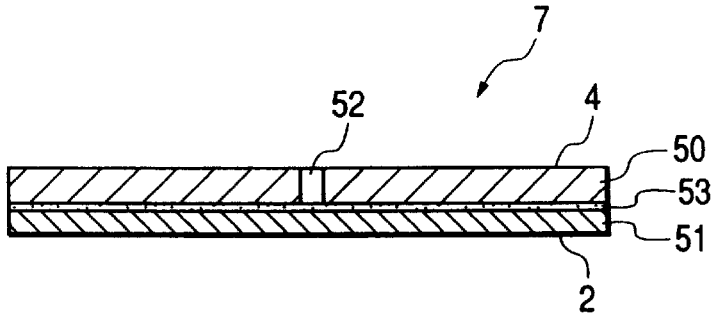
FIGS. 4A and 4B are sectional views showing embodiments of a seal member.
Figure 5A:
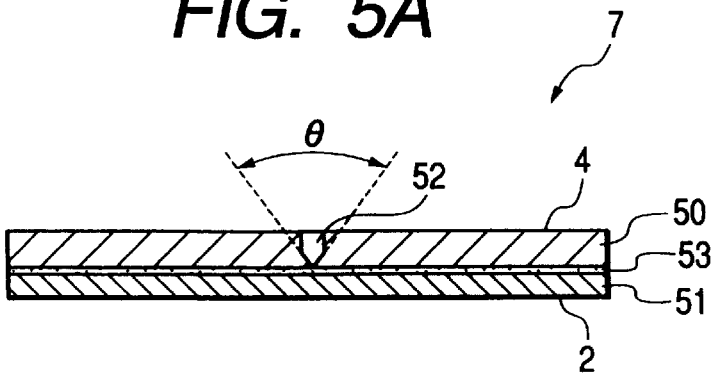
FIGS. 5A and 5B are sectional views showing embodiments of the seal member.

FIGS. 4A and 5A show embodiments of the above-described seal material 7. The seal material 7 is of a laminated structure including, at least, a physical protective layer 50 and an airtight hold layer 51 that are laminated together via an adhesion layer 53. The physical protective layer 50 is constructed by a uni-directionally drawn film that is made, for example, of polyethylene terephthalate and that has 12 $\mu$m thickness. The airtight hold layer 51 is constructed by a film of polypropylene or the same group as polypropylene to have 30 $\mu$m thickness.

It is desirable that the films forming the physical protective layer 50 and the airtight hold layer 51 are 10 to 30 $\mu$m thick and 15 to 50 $\mu$m thick respectively.

It is preferably to thermally weld or thermally attach the seal material 7, made up of the films forming the physical protective layer 50 and the airtight hold layer 51, onto the ink supply port from the viewpoints of maintaining the quality and simplifying the process, and therefore the material of the airtight hold layer 51 contacting the ink supply port is selected considering adhesion to the container main unit 2. For example, if the container main unit 2 is made of polypropylene, the film forming the airtight hold layer 51 is made of a material of polypropylene or a polypropylene group. On the other hand, for the physical protective layer 50, a material that is higher in softening or melting temperature than the airtight hold layer 51 and that is excellent in handling property is selected.

The physical protective layer 50 is formed with a slit 52 in parallel with or perpendicularly to the drawing direction of the uni-directionally drawn film forming the physical protective layer 50. The slit 52 is U-shaped or V-shaped in cross section, as shown in FIG. 5A. Forming the slit 52 into the V-shape in cross section enhances a cleaving or tearing property, and it is desirable that open angle θ is 60 degrees or less, preferably 30 degrees or less. In addition, the slit 52 shown in FIG. 4A has a flat bottom.

Figure 4B:
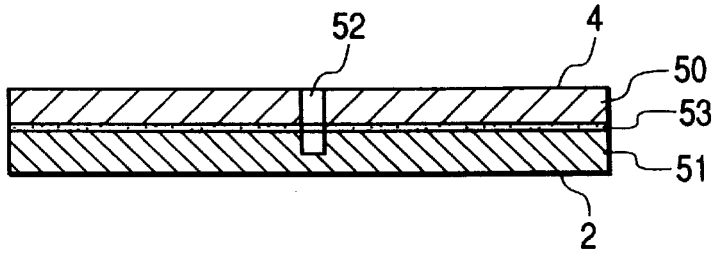
Figure 5B:
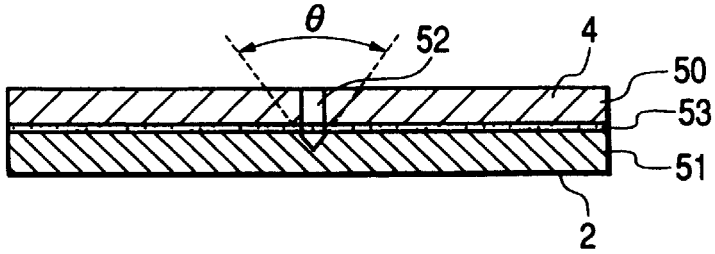

To ensure the cleaving property, the deeper slit 52 is desirable, but the deeper slit 52 will hinder the handling property because a breakage may occur during a winding step or fused adhesion step of assembling process. Therefore, in view of this, it is preferable that the airtight hold layer 51 is made a slightly thicker and the slit 52 is made in a depth to such an extent that the tip of the slit 52 slightly reaches the airtight hold layer 51, as shown in FIGS. 4B and 5B.

The slit(groove) 52 of the seal material 7 can be easily formed such that, after the physical protective layer 50 and the airtight hold layer 51 are laminated together via the thin adhesion layer 53, a cutter preferably having a tip angle of 30 degrees or less is depressed to a predetermined depth from the face of the physical protective layer 50.

The slit 52 can also be formed such that, after a cutting tool is set at a depth of the slit to be formed, the seal material 7 is relatively moved. Further, the physical protective layer 50 may be previously formed with the slit 52 by a press, etc., and then be laminated on the airtight hold layer 51. According to this process, although a cleaving assisting recess (slit) cannot be formed to reach the airtight hold layer 51, it is advantageously dispensed with depth management of the cutting tool in forming the slit.

The seal material 7 may be formed by uni-directionally drawn polyethylene terephthalate and uni-directionally drawn polypropylene which are laminated so that their drawing directions are parallel or orthogonal to each other.

Figure 2B:
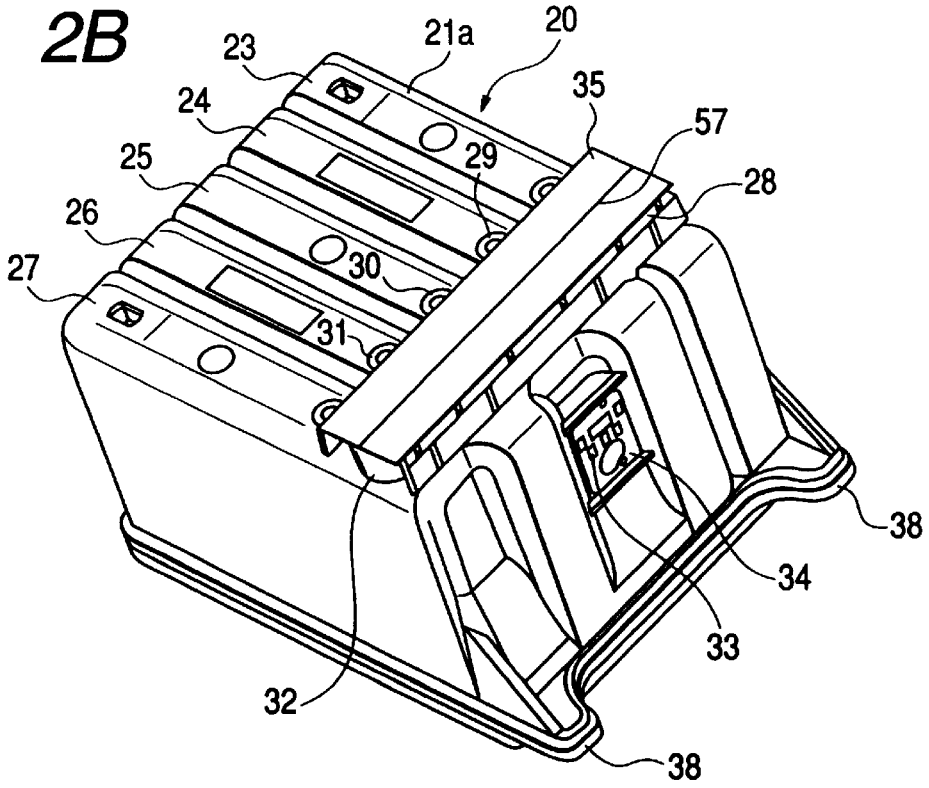

For the seal material 35 that seals the plurality of ink supply ports 28 to 32, at least one cleaving assisting slit 57 is formed, as shown in FIG. 2B, to extend in the direction in which the ink supply ports 28 to 32 are arranged, and to pass through the ink supply ports 28 to 32. A similar advantage is provided if the cleaving assisting slits 57 are separately formed for the respective ink supply ports 28 to 32, or the cleaving assisting slits 57 for the respective ink supply ports extend perpendicular to the direction in which the ink supply ports 28 to 32 are arranged.

Although a plurality of cleaving assisting slits 57 may be formed to be in parallel to each other or to cross each other, a single continuous slit 57 extending in the arrangement direction is preferable because the slit forming step can be simplified.

If the seal material 7 is formed so as to provide a light transmission property, it is possible to visually check the state of the thermal adhesion between the seal material and the ink supply ports as well as whether or not ink leakage through the packing member or the valve occurs.

The ink cartridge of this type is assembled in the following manner: A stainless filter 39 is fixed to the high polymeric container main unit 2 by thermal welding or thermal adhesion, and then the circuit board 6 on which the storage device is mounted is attached to the container main unit 2.

Further, the spring 48, the valve body 49, and the packing 45 are inserted in this order through the ink supply port 4 and assembled into the main unit 2, then the ink supply port 4 is sealed with the seal material 7. The seal material 7 serves as a member for not only preventing ink from leaking, but also preventing the packing 45 from being pushed out by the spring 48. When the seal material 7 is adhered, the cleaving assisting slit 52 is aligned to a position where the tip of the ink introduction member 42 of the carriage abuts or to the proximity of the position.

Subsequently, a porous member is pushed into the container main unit 2, and the lid 3 is thermally welded or thermally adhered to the container main unit 2. Next, the pressure in the ink chamber is reduced so that the chamber is filled with ink. Then, the ink chamber is once released to the atmosphere, but again put into the pressure-reduced condition, and in the pressure-reduced condition, the ink injection port and the ventilation hole of the lid 3 are sealed with the films 8 and 8*a*. The cartridge sealed with the films 8 and 8*a* is housed in a bag 66 made of a film having an air shield property, and is packed in the pressure-reduced condition.

Figure 6A:
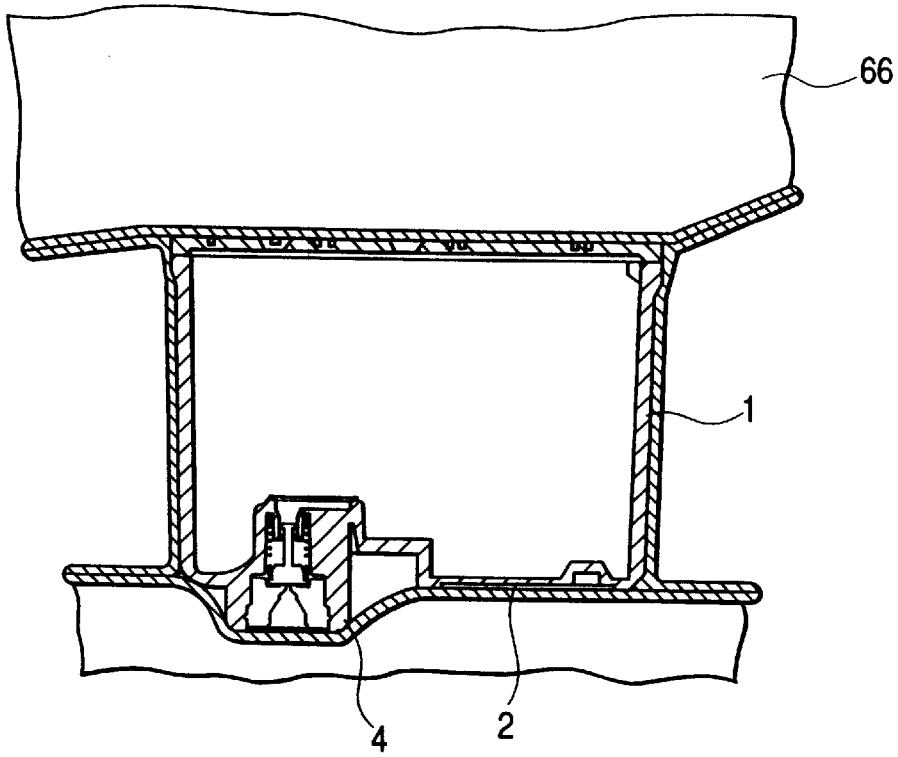
FIGS. 6A and 6B are a sectional view showing a state in which the ink cartridge is packed under pressure-reduced state, and an enlarged view of the structure in the proximity of the ink supply port in the pressure-reduced state.
Figure 6B:
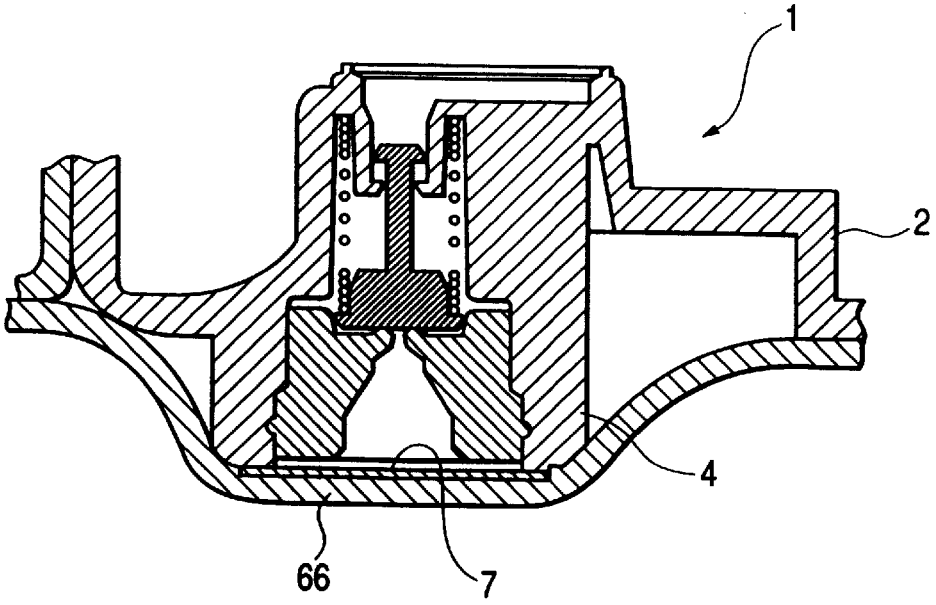

FIG. 6A shows one form of the black ink cartridge 1, which is a commercially available product in which the black ink cartridge 1 is packed by the bag 66 made of a film having a high air shield property. The cartridge 1 is distributed in this form until it is set in a printer after the cartridge 1 is manufactured. Since the ink supply port 4 projects externally from the face of the container main unit 2, the film forming the bag 66 is pushed to and closely contacted with the seal material 7 by the atmospheric pressure. Thus, as shown in FIG. 6B on an enlarged scale, if the air in the space 60 between the seal material 7 and the valve body 49 attempts to expand to swell the seal material 7 outwardly, swelling the seal material 7 outwardly is suppressed by the atmospheric pressure received on the film forming the bag 66 and therefore, the breakage of the seal material 7 caused by excessive swelling is prevented.

The inner pressure of the bag 66 forming the packing is maintained in a reduced pressure state of, for example, minus 400 to minus 650 mmHG, to establish negative pressure state. Therefore, even if the ink cartridge is left for a long term in the distribution process, the dissolved air amount of ink can be decreased over time, and in the event that ink leakage accidentally occurs, the leaked ink can be stored in the bag 66 and can be prevented from leaking out to the outside and further evaporation of ink can also be suppressed. Thus, the packing in a reduced pressure state provides the remarkable advantage in maintaining the quality of ink in a case where the ink cartridge is stored or left for a long term.

Forming the bag 66 for reduced pressure packing, of such a material as to enable visual check of the inside makes it possible to easily and visually check ink leakage in a long-term storage state. That is, a user can preliminarily know the presence or absence of ink leakage prior to opening the bag. This is very useful in maintaining the quality of the cartridge, particularly, the cartridge of the invention having the valve mechanism.

Next, a method of mounting the ink cartridge to a recorder will be discussed.

Figure 7:
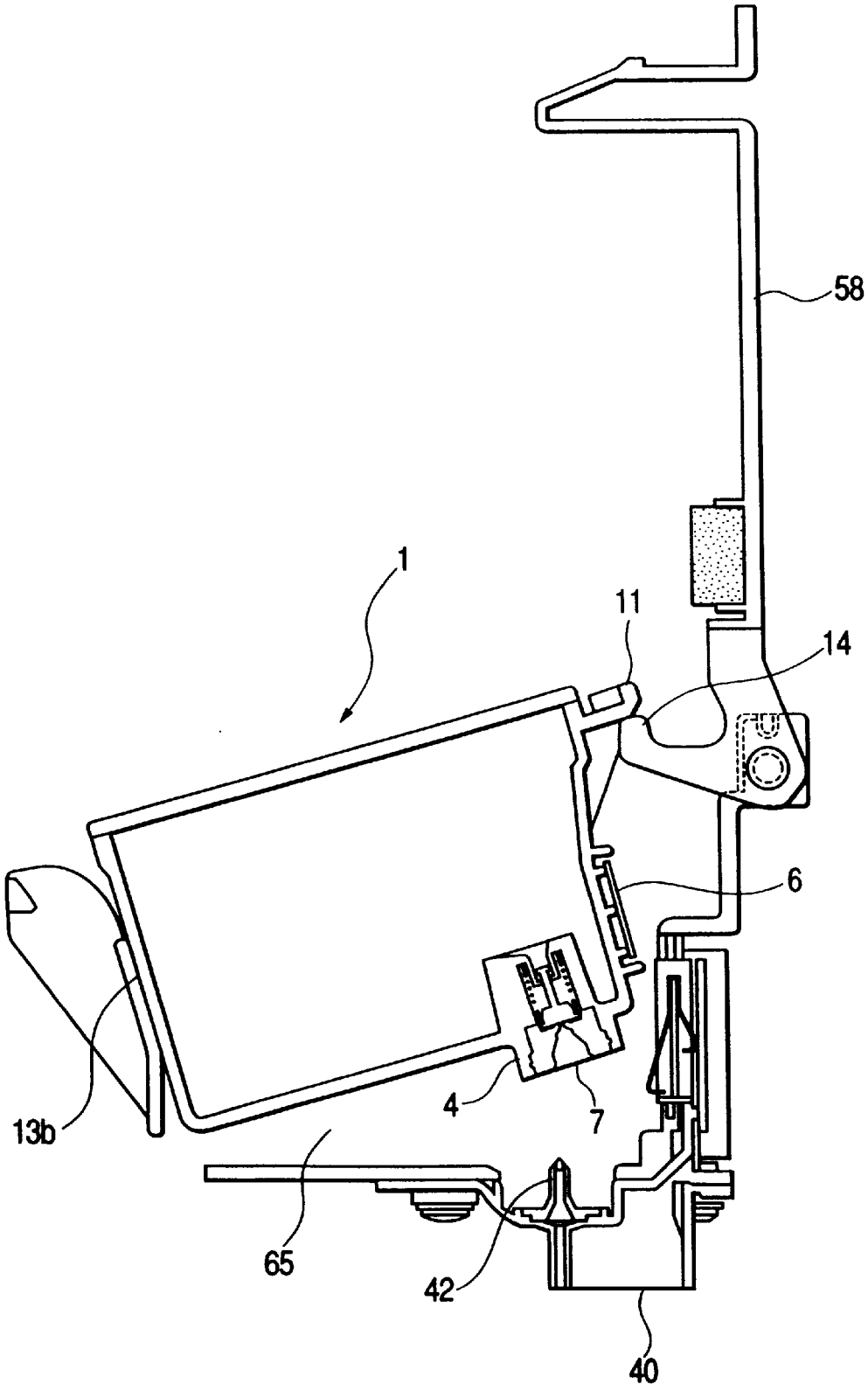
FIG. 7 shows a state in which the ink cartridge is loaded to a cartridge holder.
Figure 8:
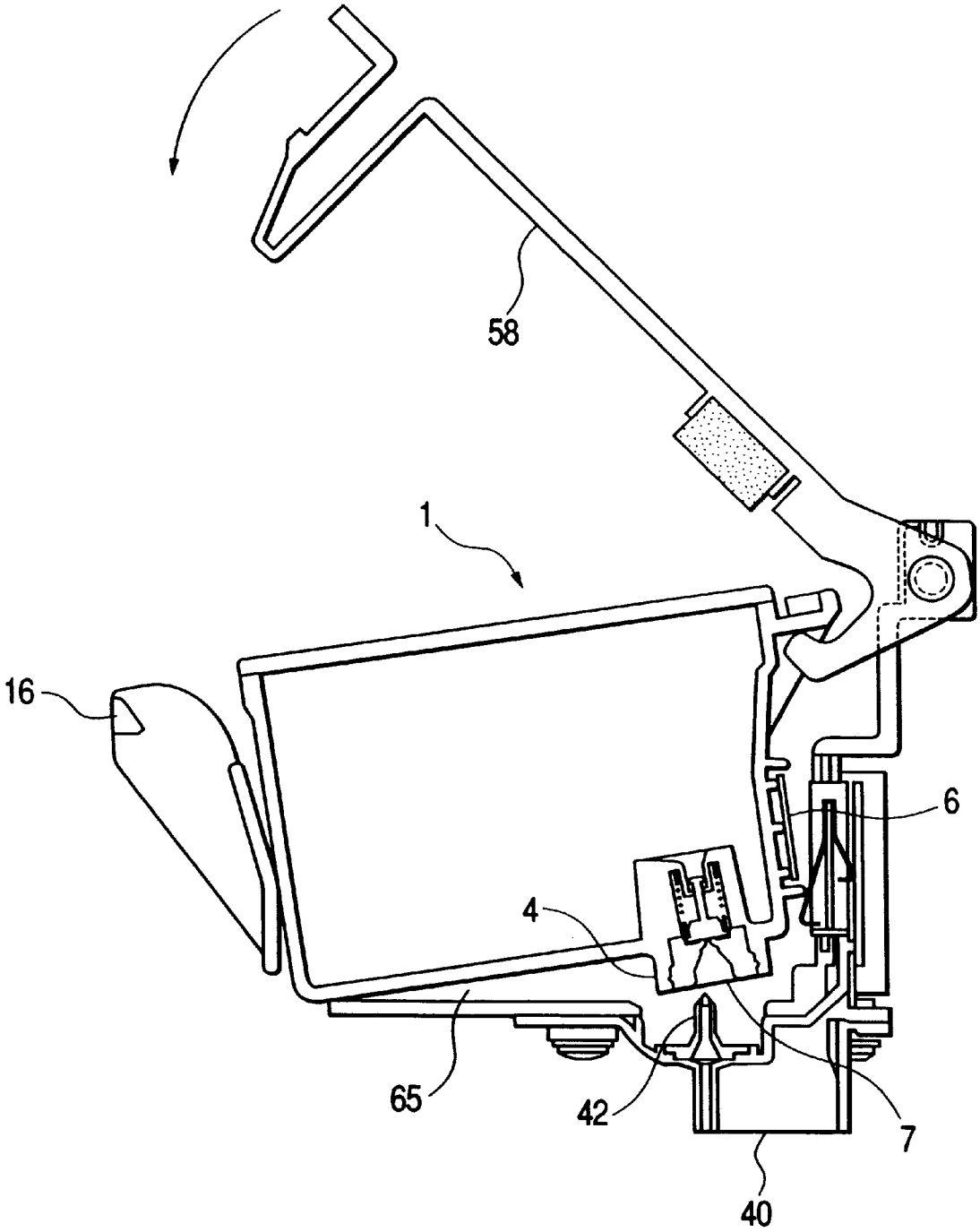
FIG. 8 shows a state in which the ink cartridge is moved to the ink supply member side by a lever after the ink cartridge is loaded to the cartridge holder.

FIGS. 7 and 8 show the process of mounting an ink cartridge by taking the black ink cartridge 1 as an example. The packing bag 66 is opened, the ink cartridge 1 is taken out therefrom, and the film 8*a* sealing the ventilation hole of the lid 3 is peeled off, then a lever 58 of a cartridge holder 65 of the carriage is opened and the cartridge 1 is loaded. A protruded part 11 of the ink cartridge 1 is received by a projection 14 of the lever 58 and an opposite end is supported on a slope part 13*b* of the cartridge holder 65.

If the lever 58 is closed in this state, the projection 14 is rotated downward and the ink supply port 4 of the ink cartridge 1 comes in contact with the tip of the ink introduction member 42, as shown in FIG. 8.

If the lever 58 is further rotated, the ink introduction member 42 is pushed into the ink supply port 4, and when the lever 61 is pushed completely, the lever 58 engages a hook part 16 so that the ink cartridge 1 is fixed to the holder 65.

To remove the ink cartridge 1 from the holder 65, the hook part 16 and the lever 58 are disengaged, then the lever 58 is rotated upward, whereby the ink cartridge 1 is pulled up by the lever 58 and the ink supply port 4 is detached from the ink introduction member 42. If the lever 58 is further rotated, the upper half of the ink cartridge 1 is exposed from the holder 65. Thus, the ink cartridge 1 can be easily removed from the holder 65.

Figure 9A:
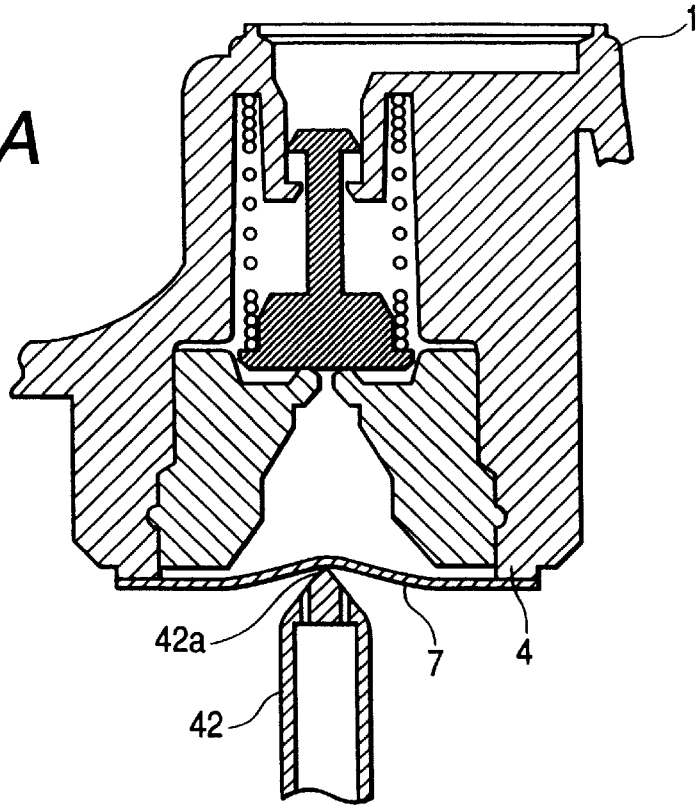
FIGS. 9A and 9B show a state in which an ink introduction member abuts the sealing material on the ink supply port of the ink cartridge and a state in which the ink introduction member breaks the seal member.
Figure 9B:
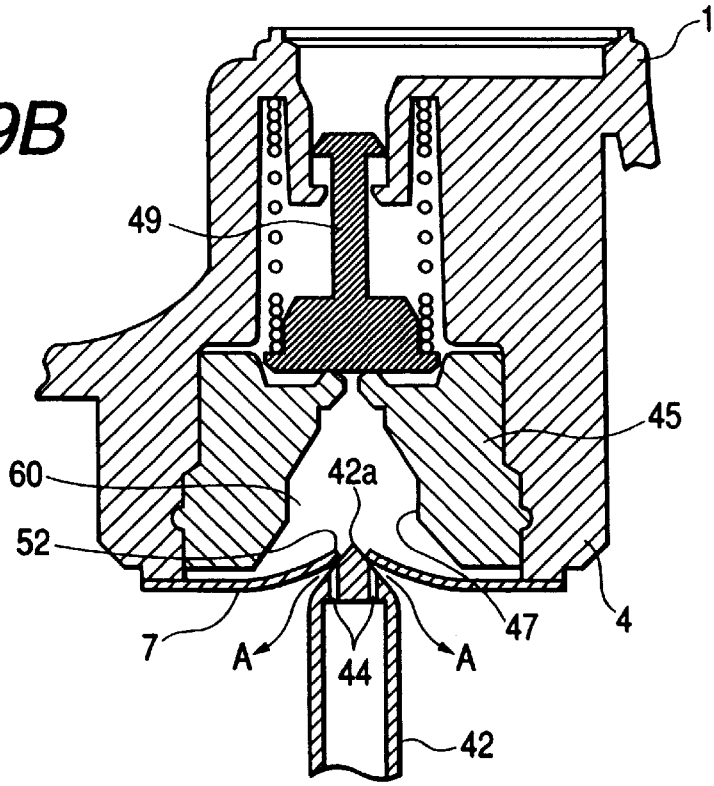

By the way, during the mounting process of the ink cartridge 1, as shown in FIG. 9A, tip 42*a* of the ink introduction member 42 abuts the cleaving assisting slit 52 of the seal material 7 directly or the proximity of the cleaving assisting slit 52. When the ink cartridge is further pushed in, the seal material 7 whose periphery is fixed by thermal adhesion receives tension by the tip 42*a* of the ink introduction member 42, so that a stress concentration occurs at the abutment part, and the seal material 7 is cleaved along the slit 52 having a weak strength spontaneously (FIG. 9B). The air A flows out or flows in through the cleaved part in such a manner that the space 60 is released to the atmosphere with the air flow not directly hitting the ink introduction ports 44 of the ink introduction member 42.

If the cartridge 1 is further pushed in, as shown in FIG. 3, the fit part 47 of the packing 45 is fitted to the ink introduction member 42, and the valve body 49 is pushed and opened, allowing the ink chamber 10 to communicate with the record head 40. Thus, the state in which ink can be supplied to the record head 40 is established.

Since the seal material 7 is high in cleaving property in the direction along the drawing direction, use of uni-directionally drawn film for the seal material on the ink supply port 4 is very effective, and forming the cleaving assisting slit 52 in parallel with the drawing direction is useful means for furthermore enhancing the effect.

By the way, to cleave the seal material 7 rapidly with a long distance by the tension applied by the pushed ink introduction member 42, it is necessary to attach the seal material 7 in a state in which tension is applied on the seal material 7, that is, to attach the stretched seal material 7 without slack, so that pushing the ink introduction member 42 will concurrently cause further tension on the seal material 7.

In the invention, the ink supply port 4 is formed into a circle shape, and the seal material 7 is fixed to the entire periphery of the ink supply port 4 by thermal adhesion. Therefore, the seal material 7 is fixed with an adequate tension. The seal material 7 is cleaved rapidly with a long distance without producing slack or peeling as the slit 52 serves as a breakage induction part when the ink introduction member 42 is pushed.

Figure 26:
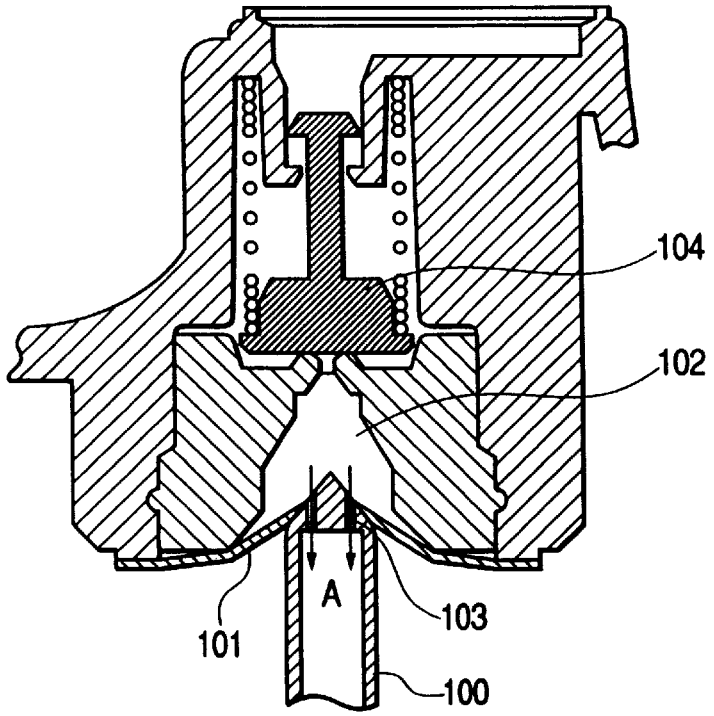
FIG. 26 shows an air flow when an ink introduction member penetrates an ink supply port of an ink cartridge.

In contrast, if the seal material 7 is formed of a material other than the uni-directionally drawn film and no slit is provided to the seal material 7, the ink introduction member 100 elastically deforms the seal material 101 largely to compress air in the space 102 between the seal material 101 and the valve body 104 as shown in FIG. 26. The seal material 101 is broken at the stage where the compression proceeds. In this state, the seal material 101 is in tightly contact with the ink introduction member 100 and thus compressed air flows into the ink introduction port 103.

FIGS. 10A, 10B 10C, 11A, 11B and 11C show other embodiments of seal material 7. In each of the embodiments, the seal material 7 has, at least, a plurality of physical protective layers (in the embodiment, two physical protective layers 54 and 55) and an airtight hold layer 51 that are laminated together via adhesion layers 56 and 53. The physical protective layers 54 and 55 are laminated so that the drawing directions of uni-directionally drawn films of polyethylene terephthalate 12 $\mu$m thick, for example, are parallel or orthogonal to each other. One physical protective layer is added, and the cleaving assisting slit 52, 52' U-shaped or V-shaped in cross section is formed to penetrate the two physical protective layers 54 and 55. This arrangement can enhance the entire rigidity of the physical protective layers 54 and 55 without degrading the cleaving property, thereby preventing the seal material 7 from curling. Therefore, the handling property can be improved, and the airtight hold layer 51 can be protected.

Figure 10A:
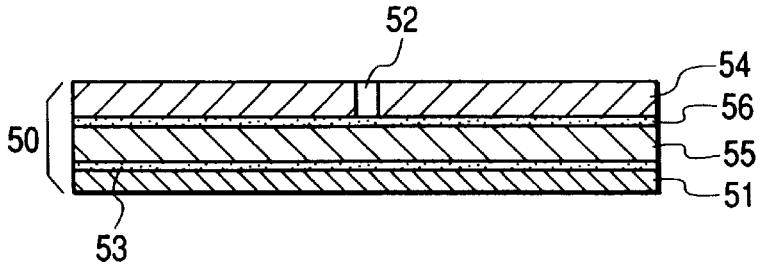
FIGS. 10A to 10C are sectional views showing embodiments of the seal member.
Figure 10B:
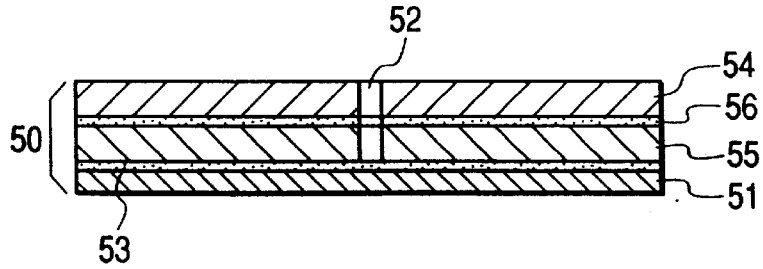
Figure 10C:
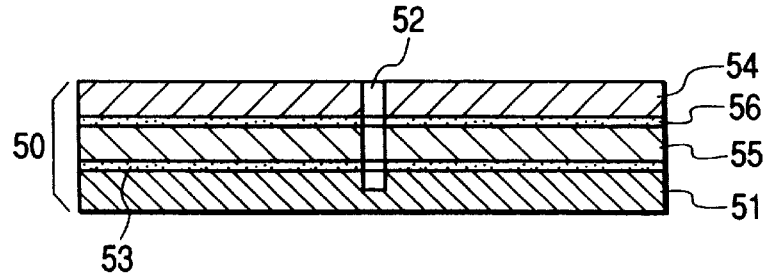
Figure 11A:
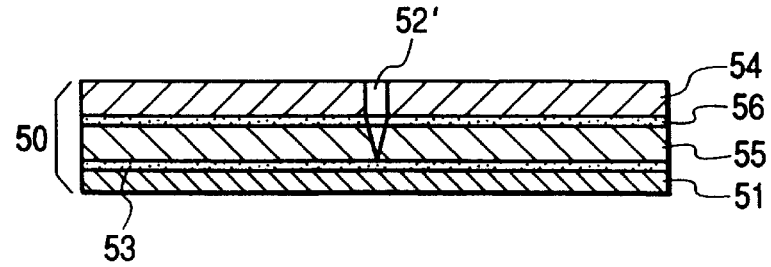
FIGS. 11A to 11C are sectional views showing embodiments of the seal member.
Figure 11B:
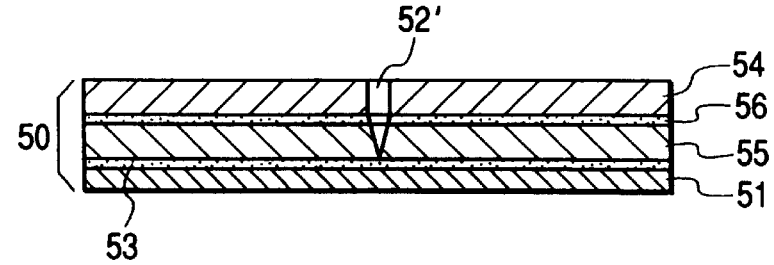
Figure 11C:
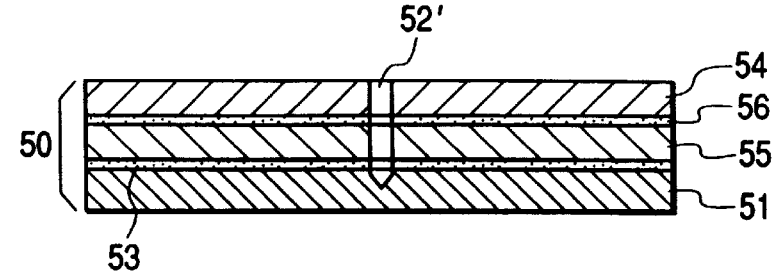

In a case where a plurality of physical protective layers are formed in this manner, if the slit is formed to extend through the physical protective layers 54 and 55 to the surface area of the lowermost layer (the airtight hold layer 51) as shown in FIGS. 10C and 11C similarly to the above-described embodiment, the cleaving property can be improved.

Figure 12A:
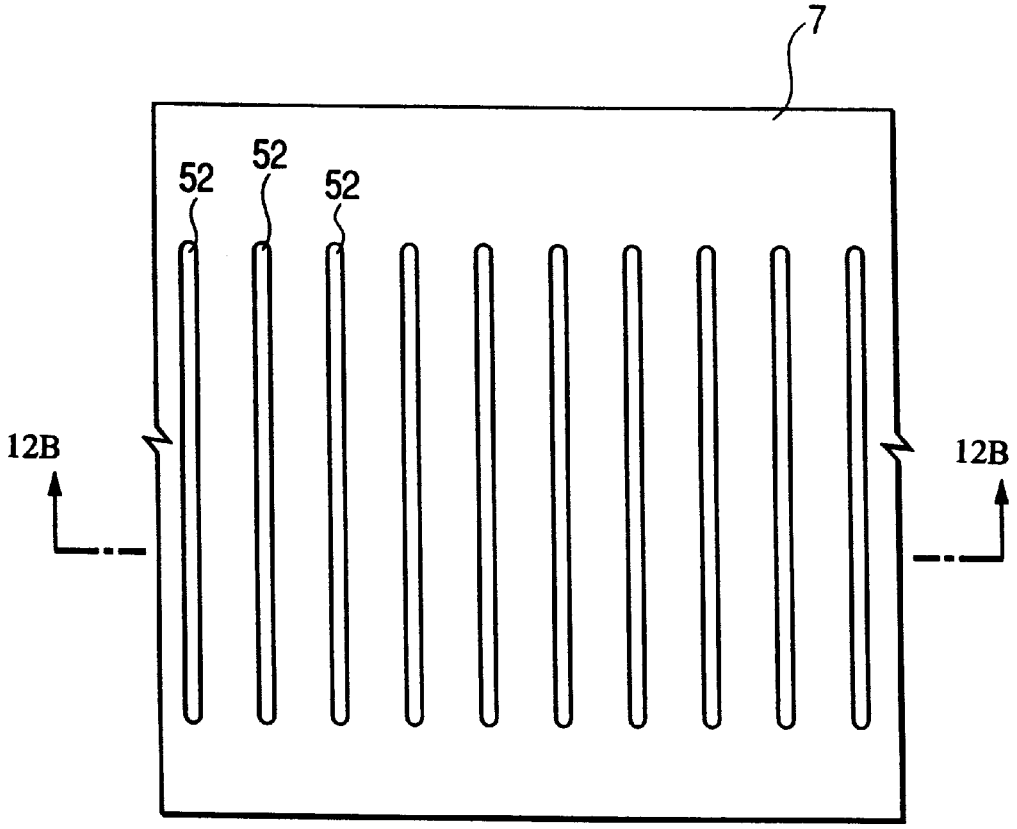
FIGS. 12A and 12B are a top view showing the arrangement state of breakage induction recesses formed in the seal material and a sectional view taken along line A—A of FIG. 12A.
Figure 12B:
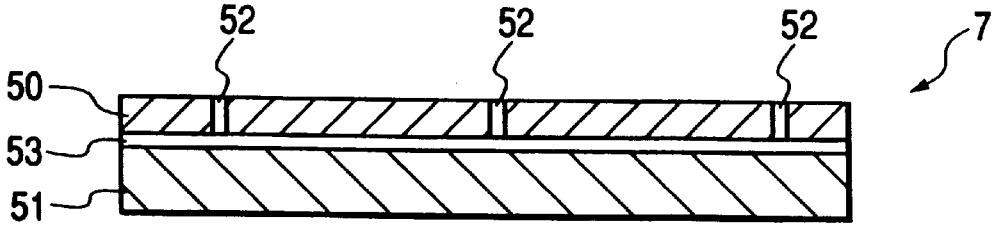
Figure 13A:
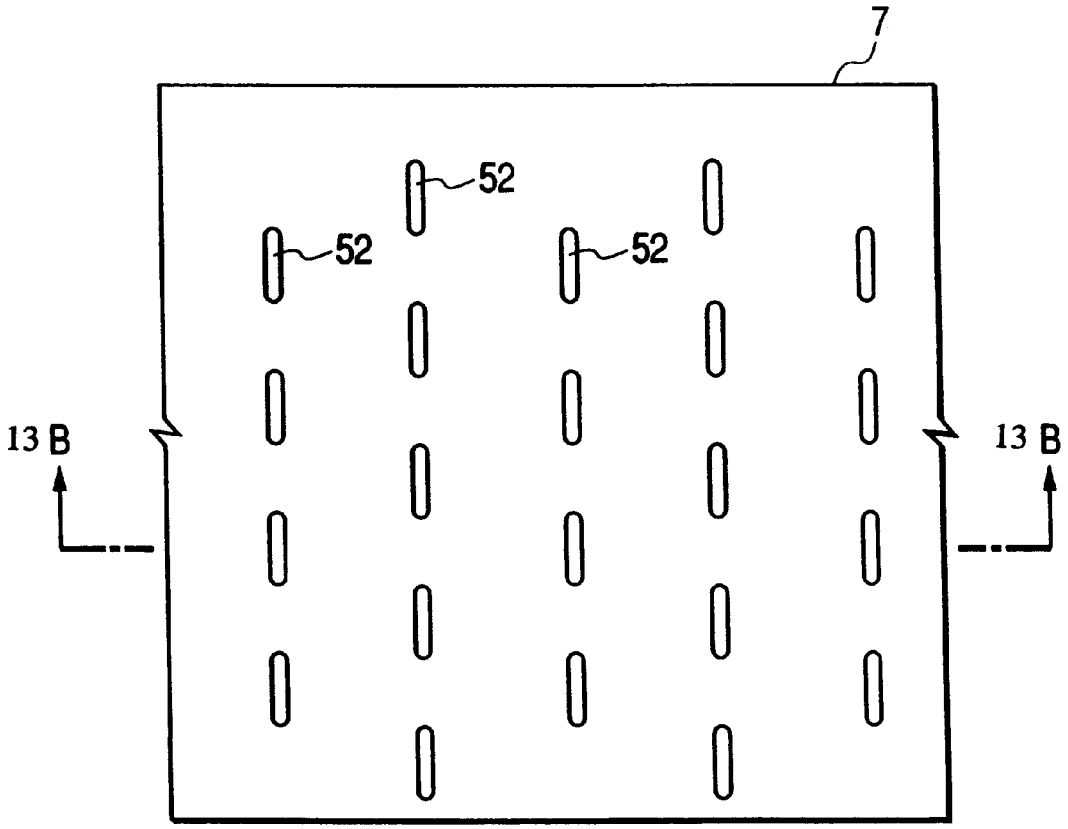
FIGS. 13A and 13B are a top view showing the arrangement state of breakage induction recesses formed in the seal material and a sectional view taken along line A—A of FIG. 13A.
Figure 13B:
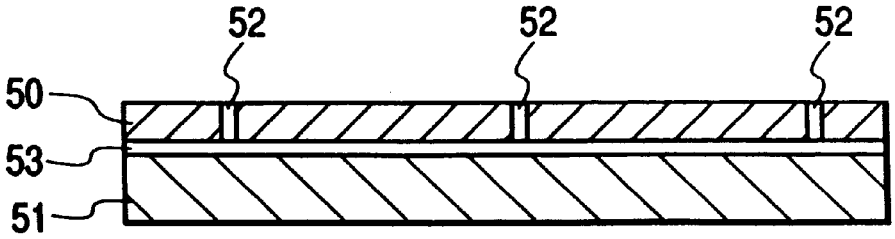

FIGS. 12 and 13 show examples of how the cleaving assisting slits are arranged in the seal material 7. As shown in FIG. 12, a plurality of linear and continuous cleaving assisting slits 52 of the physical protective layer 50 are arranged in parallel to one another at given pitches of, for example, about 1 mm. As shown in FIG. 13, a plurality of short slits 52 are formed on a single line, and plural sets of the short slits 52 are arranged in parallel to one another at given pitches of, for example, about 1 mm.

Figure 14A:
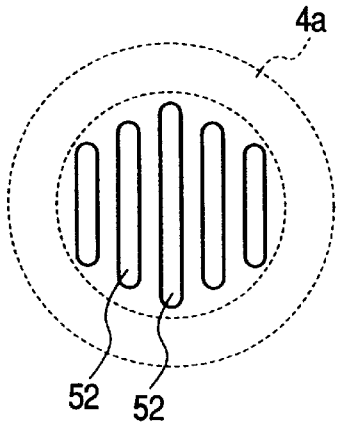
FIGS. 14A and 14B are top views, each showing a relationship between breakage induction recesses formed in the seal material and ink supply port.
Figure 14B:
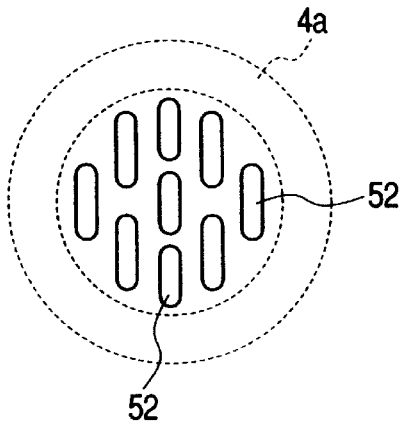

The seal material 7 thus formed is cut to have the required shape and size, and thermally adhered to the peripheral portion of the ink supply port. From the viewpoint of adhesion or the like, it is desirable that the arrangement of the slits 52 and the length of each slit 52 are so selected that the slits 52 do not exist in the peripheral portion 4*a* of the ink supply port 4, as shown in FIGS. 14A and 14B.

Figure 14C:
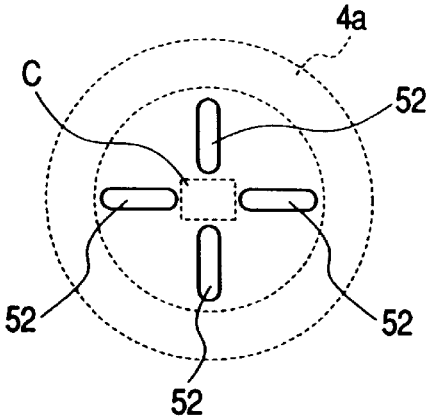
FIGS. 14C and 14D are a top view showing an arrangement of breakage induction recesses formed in the seal material with respect to the ink supply port, and a sectional view showing the state of breaking the seal material by the ink introduction member.

Further, as shown in FIG. 14C, if the slits are separated in the area that the ink introduction member 42 abuts (area denoted by letter C in FIG. 14C) so that the slits 52 do not exist in the area C, the seal material can be broken at positions away from the ink introduction member and an air flow can be prevented from hitting the ink introduction member.

Figure 14D:
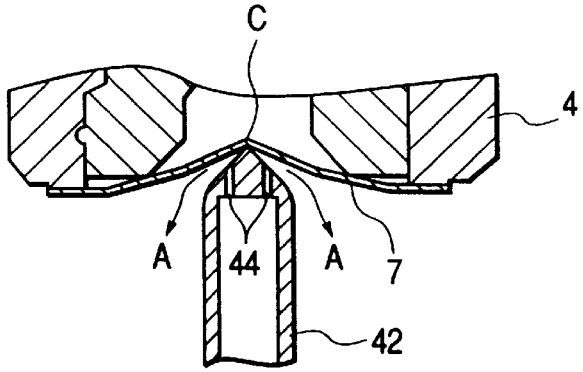

That is, as shown in FIG. 14D, as the cartridge 1 is inserted, the area C where the slits of the seal material 7 are not formed is pressed against the ink introduction member 42, and the resultant tension of the seal material 7 acts on the slits 52 outside the area C and the cleaving of the seal material 7 is started at positions away from the ink introduction member 42.

Figure 15A:
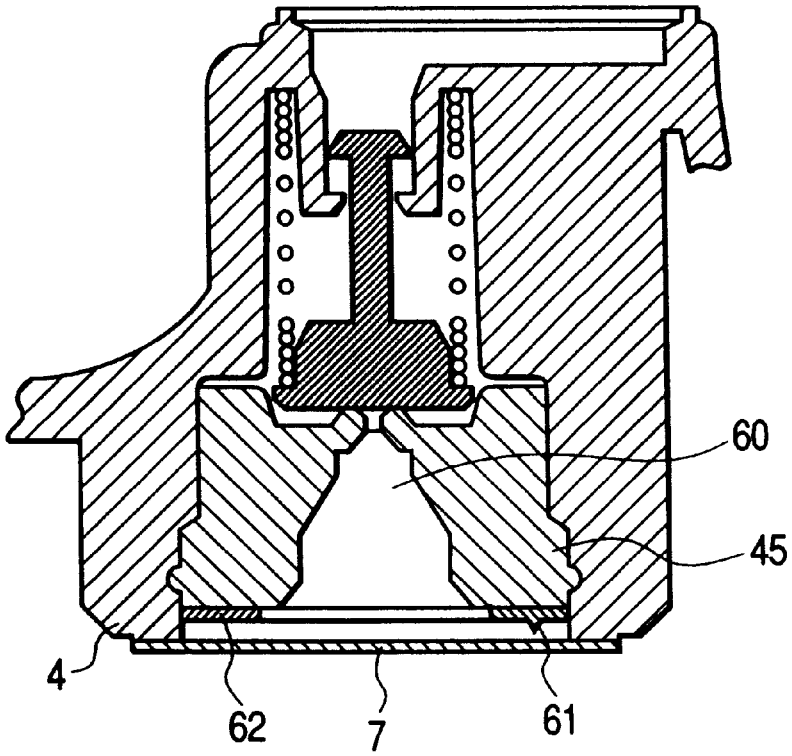
FIGS. 15A and 15B are a sectional view showing an embodiment of the ink cartridge of the invention in an enlarged manner with respect to the vicinity of the ink supply port, and a perspective view showing a member forming a breakage induction part for breaking seal material.
Figure 16A:
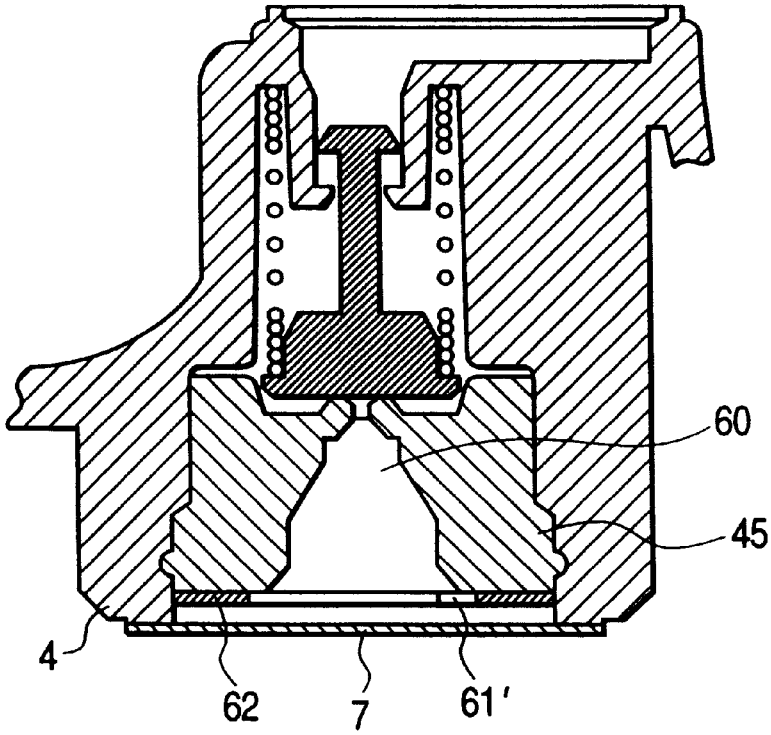
FIGS. 16A and 16B are a sectional view showing an embodiment of ink cartridge of the invention in an enlarged manner with respect to the vicinity of ink supply port, and a perspective view showing a member forming a breakage induction part for breaking seal material.

By the way, in the above-mentioned embodiments, the seal material 7 sealing the ink supply port 4 includes a uni-directionally drawn film, and a long cleaving part is formed using the ink introduction member 42. However, as shown in FIGS. 15A and 16A, a projection 61 or 61' having a sharp tip may be formed to protrude in the direction toward the peripheral portion 4*a* of the ink supply port 4 or in the direction toward the center of the ink supply port 4. When the seal material 7 is pushed in by the ink introduction member 42, the seal material 7 comes first in contact with the projection 61 or 61' so that a hole is first formed at a position away from the ink introduction member 42. Therefore, air in the space 60 is discharged at the position away from the ink introduction member 42 and can be prevented from entering the ink introduction ports 44.

Figure 15B:
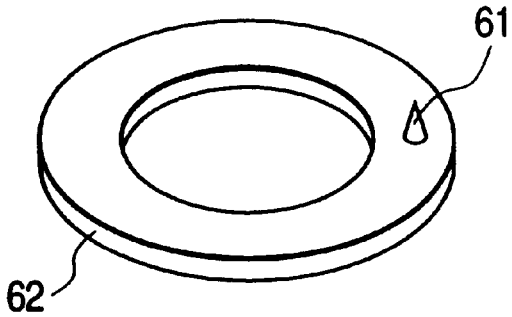
Figure 16B:
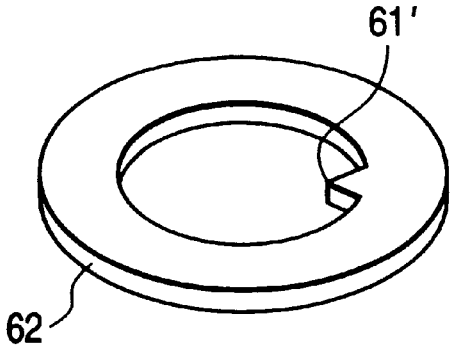

The projection 61 or 61' can be easily provided such that, as shown in FIGS. 15B and 16B, an annular base 62 having the projection 61 or 61' protruding from the surface or toward the center is disposed outside the packing 45.

Figure 17A:
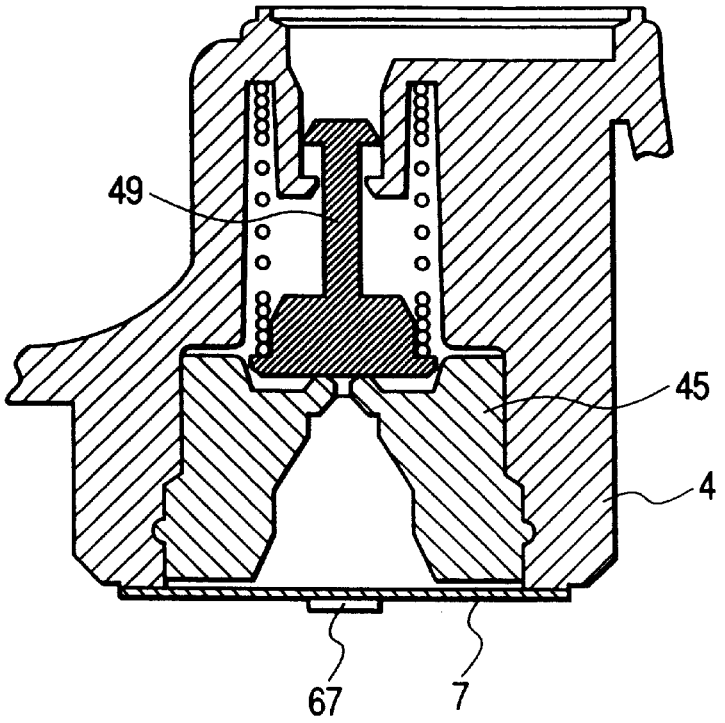
FIGS. 17A and 17B are a sectional view showing another embodiment of ink cartridge of the invention in an enlarged manner with respect to the vicinity of ink supply port, and a top view showing the structure of a seal material on the ink supply port.
Figure 17B:
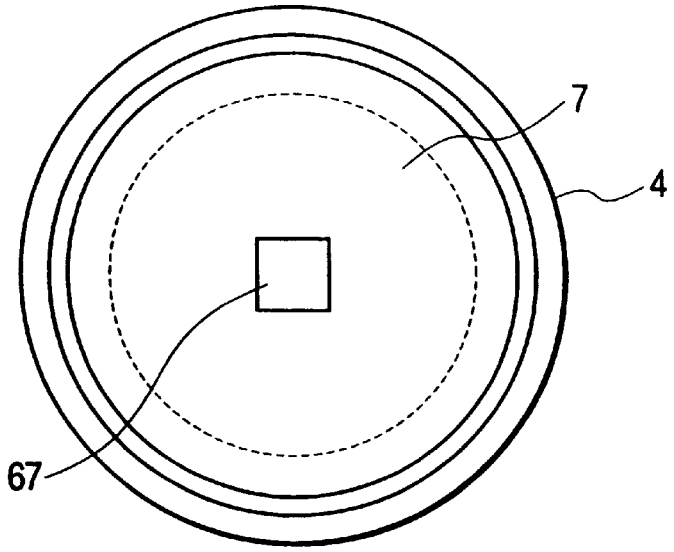

FIGS. 17A and 17B show another embodiment having means for first breaking the seal material 7 in an area away from the ink introduction member 42. A reinforcing material 67 is fixed to the outside of the seal material 7. The size of the reinforcing material 67 is so selected as to coveringly extend to an area slightly outer than an area where the ink introduction member 42 abuts. That is, the reinforcing material covers an area of the seal material 7 so as to prevent the air ejected in conjunction with the breakage of the seal material 7 from being directly hit onto the ink introduction port 44. The reinforcing material 67 is higher in rigidity than the seal material 7.

Figure 18A:
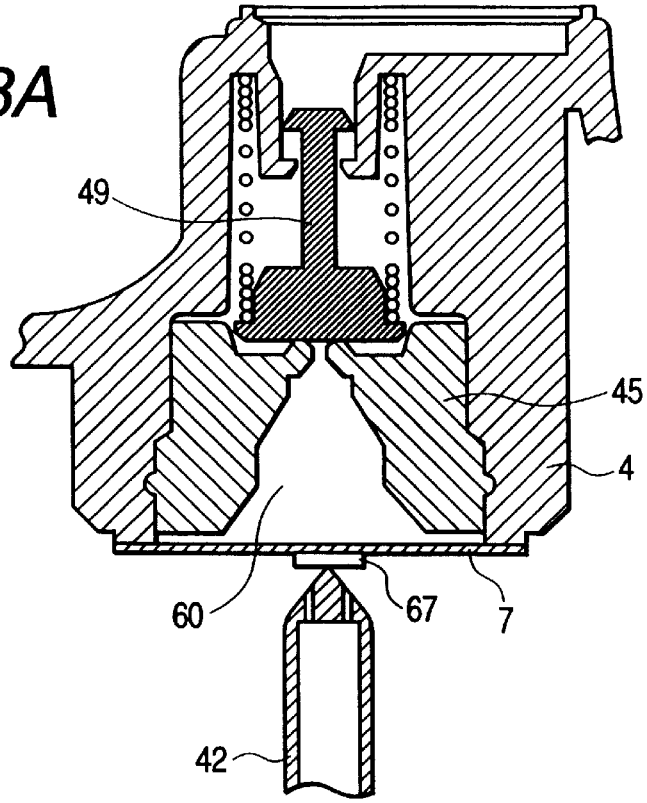
FIGS. 18A and 18B show the state in which ink introduction member abuts the seal material on the ink supply port of the ink cartridge shown in FIG. 17, and the breakage state of the seal material.
Figure 18B:
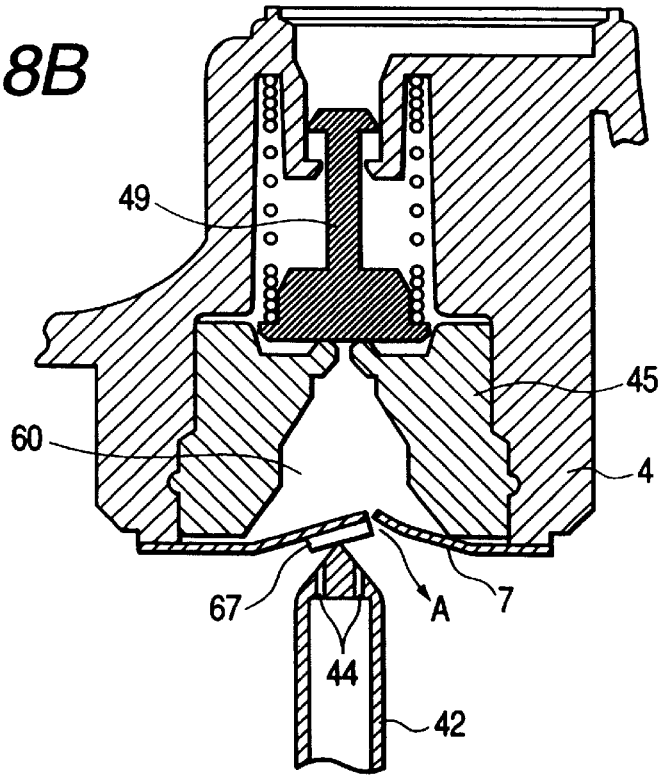

According to the embodiment, after the tip of the ink introduction member 42 abuts the reinforcing material 67 as shown in FIG. 18A, the ink cartridge 1 is further pushed so that the seal material 7 is broken at a peripheral edge of the reinforcing material 67, i.e. at a position away from the ink introduction member 42, as shown in FIG. 18B. Therefore, the air in the space 60 of the ink supply port 4 is released before the ink introduction port 44 engages the packing 45 in fluid-sealing relation.

According to the embodiment, the seal material 7 can be broken to release the space 60 of the ink supply port 4 to the atmosphere without entering air into the ink introduction port 44 of the ink introduction member 42, regardless of the shape of the tip of the ink introduction member 42, regardless of the characteristic of the seal material 7, namely, whether or not the seal material has a uni-directionally drawn property, and regardless of the presence or absence of the slit 52.

Figure 19:
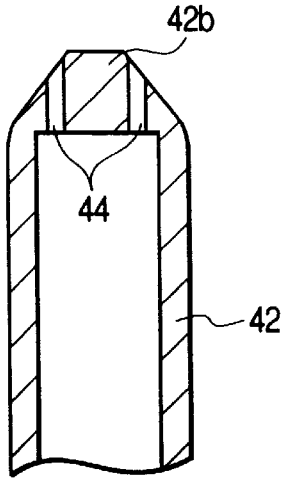
FIG. 19 shows an embodiment of an ink introduction member applicable to the ink cartridge.

FIG. 19 shows one embodiment of the ink introduction member, which is applicable to the above-described breaking technique of the seal material 7. The ink introduction member is formed into a truncated conical shape to have a flat part 42*b* at its tip end.

According to the embodiment, the flat part 42*b* is pressed to the seal material 7 to apply a tension to the seal material 7, thereby breaking the seal material 7 at a position away from the ink introduction ports 44 with the aid of the slit 52, the projection 61, 61', the reinforcing material 67, etc.

Figure 20A:
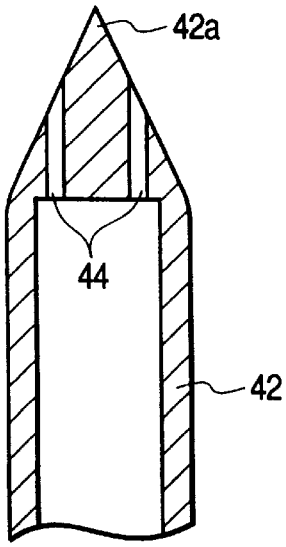
FIGS. 20A and 20B are a sectional view and a front view showing an embodiment of an ink introduction member having a seal material breaking function.
Figure 20B:
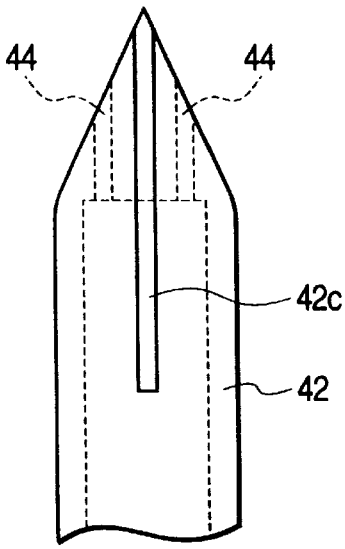
Figure 21A:
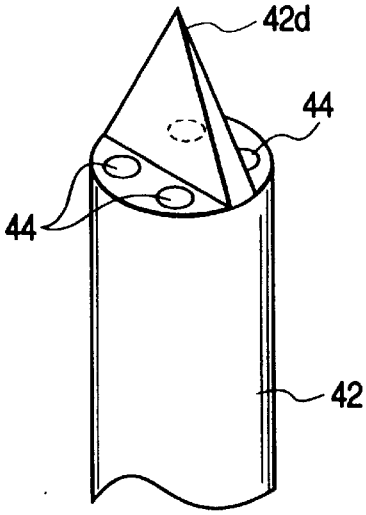
FIGS. 21A and 21B are a sectional view and a front view showing an embodiment of an ink introduction member having a seal material breaking function.
Figure 21B:
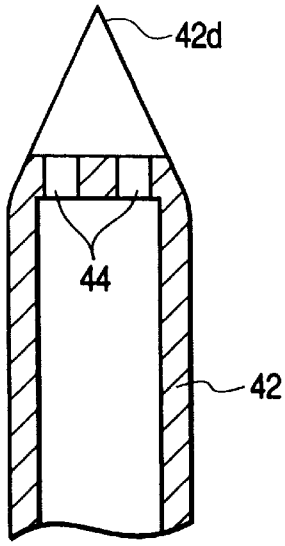

FIGS. 20 and 21 show embodiments of the ink introduction member, which are appropriate for breaking the seal material 7 without allowing air in the space 60 of the ink supply port 4 to flow into the ink introduction port 44 regardless of property of the seal material.

In the embodiment shown in FIG. 20B, at least one groove 42*c* is formed on the surface of the ink introduction member 42. The groove 42*c* extends from the proximity of the tip 42*a* of the ink introduction member 42, i.e. from a position ahead of the ink introduction port 44, toward the proximal end of the ink introduction member 42.

According to the embodiment, when the tip 42*a* penetrates the seal material, air in the space 60 of the ink supply port 4 is released to the atmosphere via the groove 42*c*, and then the ink introduction port 44 is moved into the space 60. Consequently, air can be prevented from entering the ink introduction port 44.

In the embodiment shown in FIG. 21, a sharp-pointed part 42*d* is formed so as to project to the tip side ahead of the ink introduction port 44. Since the seal material is broken by the sharp-pointed part 42*d* before the ink introduction port 44 below the sharp-pointed part 42*d* is fitted to the packing 45, air compressed in the space 60 can also be prevented from entering the ink introduction port 44.

In the above-described embodiment, the seal material is broken to release air before the ink introduction port 44 of the ink introduction member 42 is fitted to the packing 45, but the volume of the space 60 may be decreased.

Figure 22A:
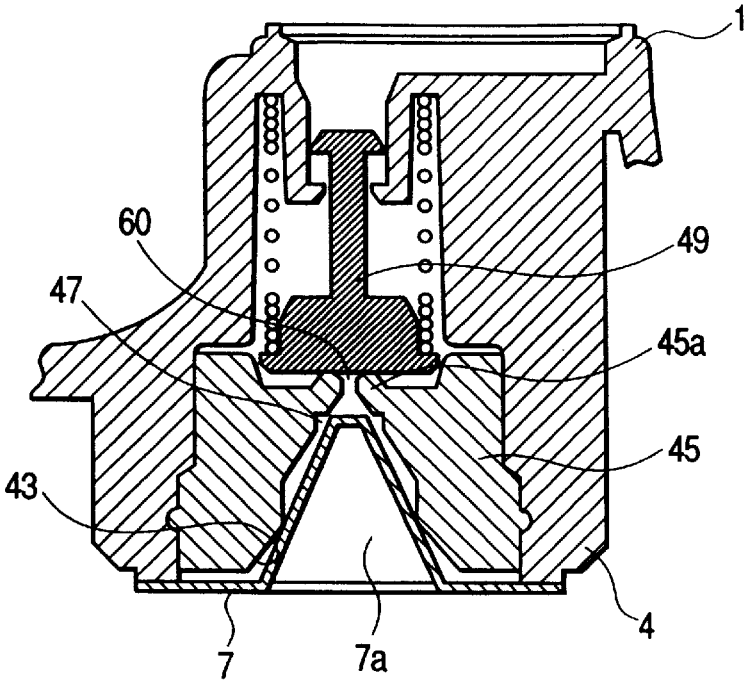
FIGS. 22A and 22B show an embodiment of the ink cartridge of the invention in an enlarged manner with respect to the ink supply port, and show the state in which ink introduction member abuts.

That is, FIG. 22 shows one embodiment in which the volume of the space 60 formed by the packing 45 and the seal material 7 can be reduced to be minimal. The seal material 7 is formed with cup-shaped convex parts 7*a*, each corresponding in shape to the taper part 43 and fit part 47 of the packing 45, as shown in FIGS. 23A and 23B.

According to the embodiment, when the tip of the ink introduction member 42 is deeply inserted into the packing

Figure 22B:
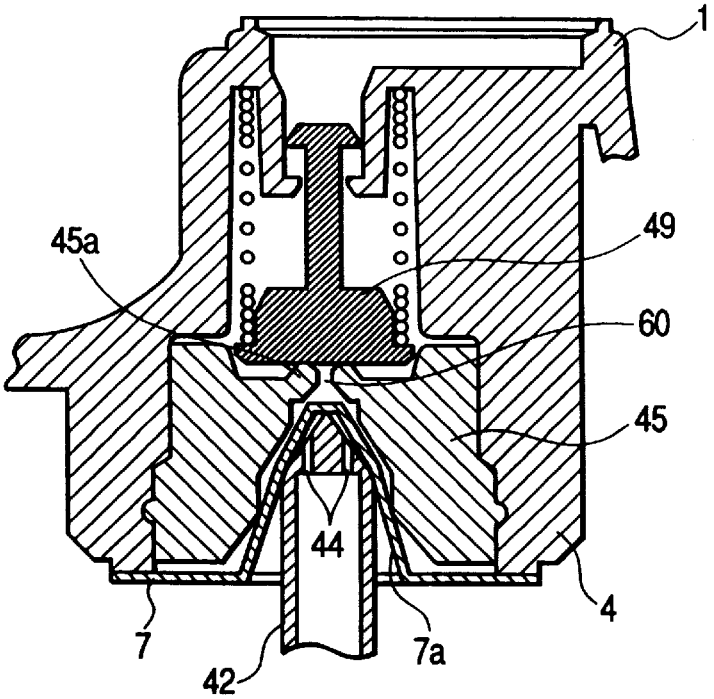
Figure 23A:
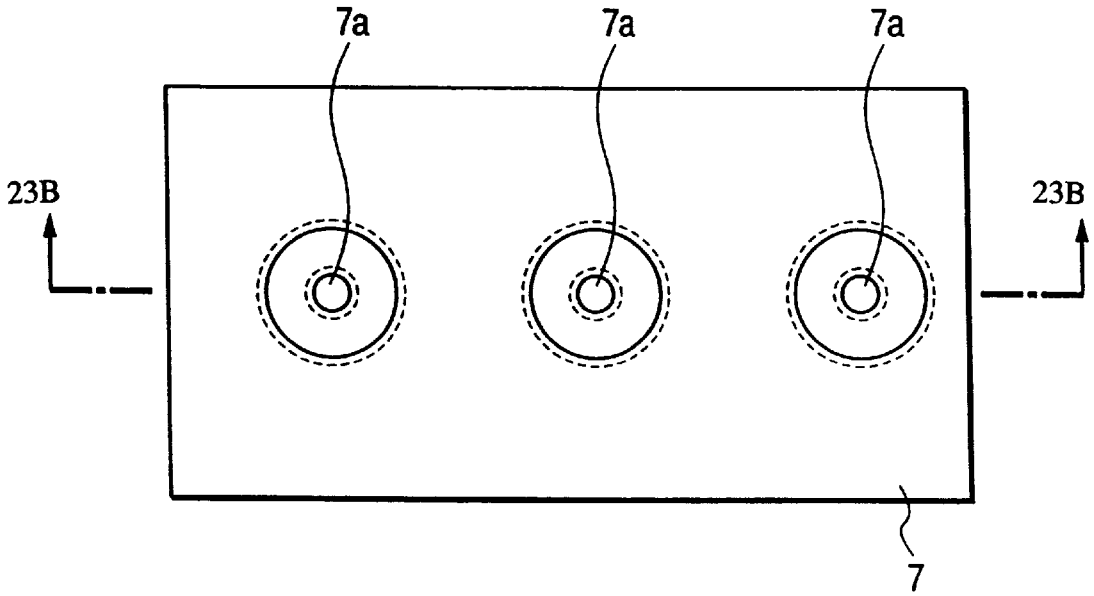
FIGS. 23A and 23B are a top view showing an embodiment of a seal member, which is appropriate for the ink cartridge shown in FIG. 22, and a sectional view taken along line C—C of FIG. 23A.
Figure 23B:
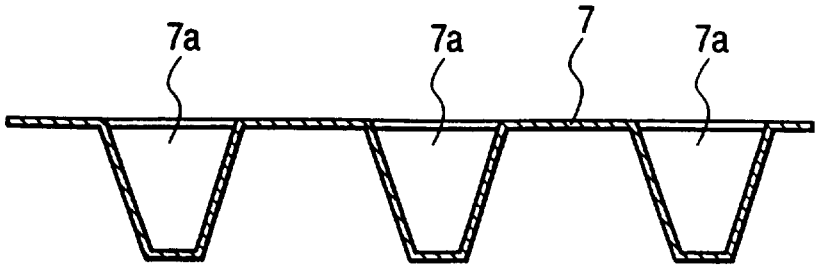

45, the tip of the ink induction member 42 abuts the seal material 7, as shown in FIG. 22B. Thus, even if the seal material 7 is elastically deformed, air in the space 60 is not excessively compressed, and air can be prevented from entering from the ink introduction port 44.

Since the ink introduction member 42 comes in elastic contact with a thinnest part 45*a* of the packing 45 and then passes through the thinnest part 45*a*, the seal material 7 is prevented from being bitten into the thinnest part 45*a*, and the ink introduction member 42 and the packing 45 are maintained in fluid-sealing relation.

Figure 24:
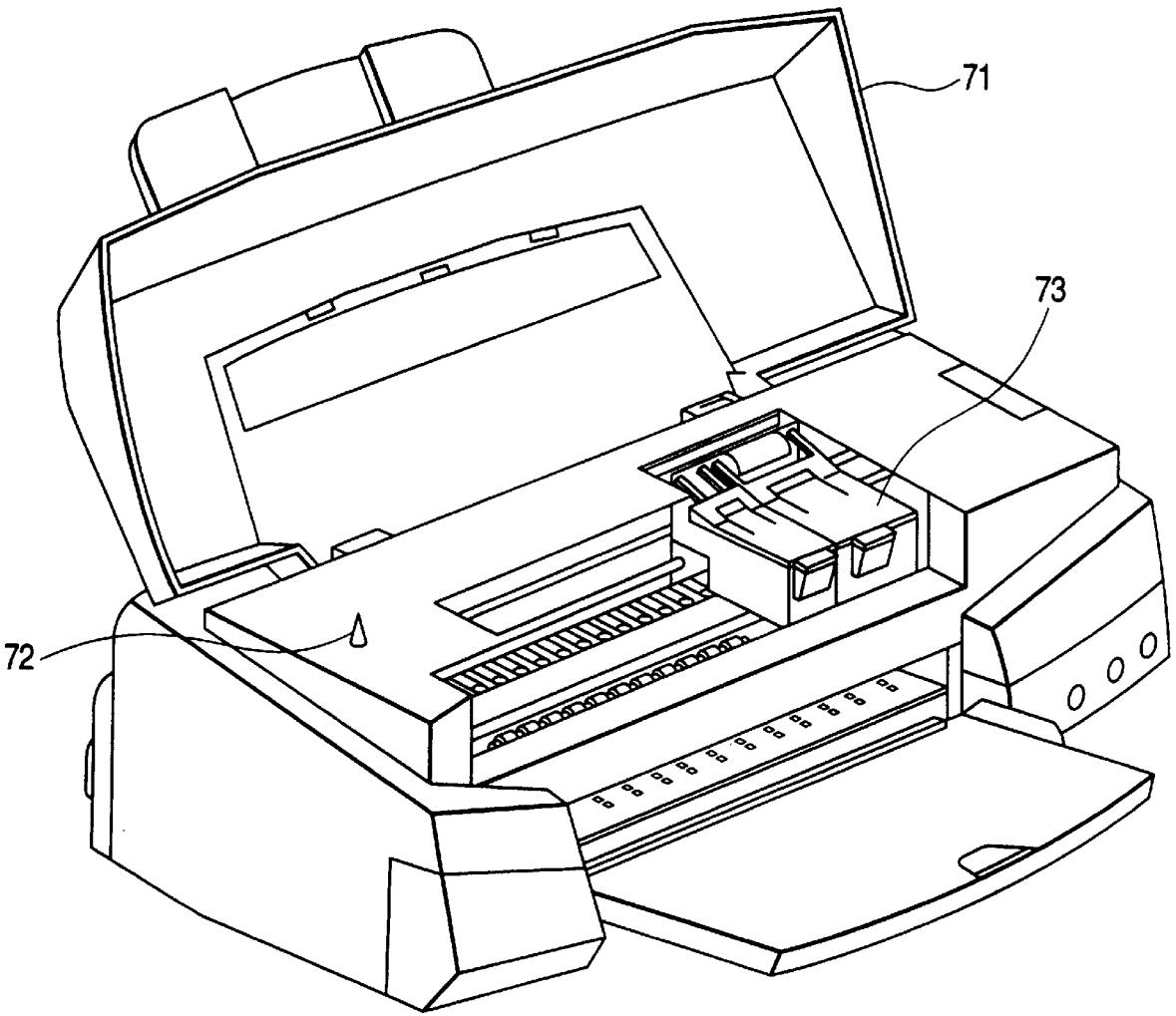
FIG. 24 show one embodiment of a recorder having a seal material breaking mechanism.

As a method of breaking the seal material, a projection 72 may be provided at a point of the recorder normally covered with a cover 71 and opened only when an ink cartridge is replaced, as shown in FIG. 24.

In the embodiment, the ink cartridge is taken out from the bag 66 (FIG. 6), and then the ink supply port 4 of the cartridge is pressed to the projection 72 to preliminarily break the seal material using the projection 72 prior to the mounting of the cartridge. Thereafter, the ventilation hole film 8*a* on the lid is peeled off, and then the cartridge is mounted to a cartridge holder 73. After the ventilation hole film 8*a* is peeled off, the seal material 7 may be broken using the projection 72, and the cartridge may be mounted.

According to this embodiment, the ink cartridge can be mounted without entering air in the ink supply member, without requiring a structure for inducing a breakage on the seal material of the ink cartridge or the ink introduction member of the recorder.

Figure 25:
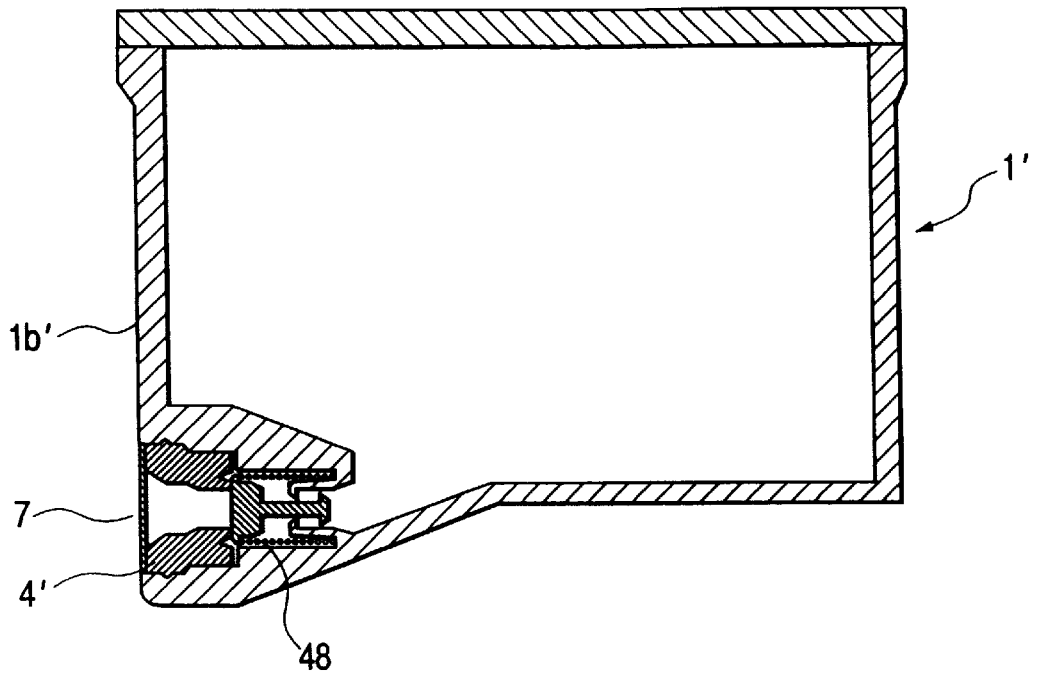
FIG. 25 is a sectional view showing an embodiment of the ink cartridge to which the invention is applicable.

In the above-described embodiments, the cartridge to be mounted in the vertical direction is taken as an example, but the invention can also be applied to an ink cartridge 1 with an ink supply port 4 formed in a vertical wall 1*b*, as shown in FIG. 25.

As described above, according to the invention, a breakage induction part is provided to the seal material or the proximity of the ink supply port. Thus, the seal material is broken to release the space closed by the ink passage open/close section and the seal material to the atmosphere, and then the ink introduction member is inserted into the ink supply port in fluid-sealing relation. Therefore, the air is prevented from entering the ink introduction port.

What is claimed is:

1. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port;

a seal material sealing the ink supply port; and a breakage induction part provided to the seal material or a proximity of the ink supply port.

2. The ink cartridge as claimed in claim 1, wherein the breakage induction part is formed by discontinuously changing a thickness of the seal material in a proximity of an area where the ink introduction member abuts.

3. The ink cartridge as claimed in claim 1, wherein the breakage induction part includes at least one recess provided to a side of the seal material where the ink introduction member abuts.

4. The ink cartridge as claimed in claim 3, wherein the at least one recess is disposed within an inner area surrounded by a peripheral portion of said ink supply port.

5. The ink cartridge as claimed in claim 3 or 4, wherein a bottom of the recess is formed into a V shape in cross section.

6. The ink cartridge as claimed in claim 3, wherein the at least one recess extends across the ink supply port.

7. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port;

a seal material sealing the ink supply port; and a breakage induction part provided to the seal material, wherein the seal material is constructed by at least one uni-directionally drawn film.

8. The ink cartridge as claimed in claim 7, wherein the seal material has a laminated construction of plural films including the at least one uni-directionally drawn film, and a slit is formed as the recess so that a bottom of the slit is located in one of films, which contacts the ink supply port.

9. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port;

a seal material sealing the ink supply port; and a breakage induction part provided to the seal material, wherein the breakage induction part includes a highly rigid part that is not broken by the ink introduction member and that is located to cover an area of the seal material where the ink introduction member abuts, and wherein the seal material is first broken in an area where the highly rigid part is not formed as the ink introduction member abuts the highly rigid part.

10. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port;

a seal material sealing the ink supply port; and a projection provided in an area where the seal material abuts when the seal material is pressed by the ink introduction member, whereby the projection assists in breaking the seal material.

11. The ink cartridge as claimed in claim 10, wherein the projection is protruded toward the seal material or toward a center of the ink supply port.

12. The ink cartridge as claimed in claim 1 or 10, wherein the ink supply port is tubular, and the seal material is thermally adhered to a peripheral portion of the ink supply port.

13. The ink cartridge as claimed in claim 1 or 10, wherein the seal material is constructed by at least one light-transmissible film.

14. The ink cartridge as claimed in claim 1 or 10, wherein the seal material has a layered construction of at least a physical protective layer and an airtight hold layer.

15. The ink cartridge as claimed in claim 1 or 10, wherein the ink passage open/close section includes a valve body that is constantly urged by an elastic member to the ink supply port to close a flow passage and that is retreated as the ink introduction member is advanced to open the flow passage.

16. An ink cartridge comprising:

a container storing ink therein;

an ink supply port into which an ink introduction member communicating through an ink introduction port with a record head is to be inserted;

an ink passage open/close section that is opened and closed as the ink introduction member is advanced and retreated to and from the ink supply port; and a seal material that seals the ink supply port and that is first broken with the aid of a breakage induction part, wherein the breakage induction part comprises a recess in said seal material, further wherein said recess does not extend completely through a thickness of said seal material, and wherein, after the seal material is broken using the ink introduction member to release a space closed by said ink passage open/close section and the seal material to the atmosphere, the ink introduction port communicates with the ink supply port.

17. The ink cartridge as claimed in claim 16, wherein the breakage induction part is formed by discontinuously changing a thickness of the seal material in a proximity of an area where the ink introduction member abuts.

18. The ink cartridge as claimed in claim 16, wherein the breakage induction part includes at least one recess provided to a side of the seal material where the ink introduction member abuts.

19. The ink cartridge as claimed in claim 18, wherein the at least one recess is disposed within an inner area surrounded by a peripheral portion of said ink supply port.

20. The ink cartridge as claimed in claim 18 or 19, wherein a bottom of the recess is formed into a V shape in cross section.

21. The ink cartridge as claimed in claim 18, wherein the at least one recess extends across the ink supply port.

22. The ink cartridge as claimed in claim 16, wherein the seal material is constructed by at least one uni-directionally drawn film.

23. The ink cartridge as claimed in claim 22, wherein the seal material has a laminated construction of plural films including the at least one uni-directionally drawn film, and a slit is formed as the recess so that a bottom of the slit is located in one of films, which contacts the ink supply port.

24. An ink cartridge comprising:

a container storing ink therein;

an ink supply port into which an ink introduction member communicating through an ink introduction port with a record head is to be inserted;

an ink passage open/close section that is opened and closed as the ink introduction member is advanced and retreated to and from the ink supply port; and a seal material that seals the ink supply port and that is first broken with the aid of a breakage induction part, wherein the breakage induction part includes a highly rigid part that is not broken by the ink introduction member and that is located to cover an area of the seal material where the ink introduction member abuts, and wherein the seal material is first broken in an area where the highly rigid part is not formed as the ink introduction member abuts the highly rigid part, and wherein, after the seal material is broken using the ink introduction member to release a space closed by said ink passage open/close section and the seal material to the atmosphere, the ink introduction port communicates with the ink supply port.

25. An ink cartridge comprising:

a container storing ink therein;

an ink supply port into which an ink introduction member communicating through an ink introduction port with a record head is to be inserted;

an ink passage open/close section that is opened and closed as the ink introduction member is advanced and retreated to and from the ink supply port; and a seal material that seals the ink supply port and that is first broken with the aid of a breakage induction part, wherein the breakage induction part includes a projection that is provided in an area where the seal material abuts when the seal material is pressed by the ink introduction member, whereby the projection assists in breaking the seal material, and wherein, after the seal material is broken using the ink introduction member to release a space closed by said ink passage open/close section and the seal material to the atmosphere, the ink introduction port communicates with the ink supply port.

26. The ink cartridge as claimed in claim 25, wherein the projection is protruded toward the seal material or toward a center of the ink supply port.

27. The ink cartridge as claimed in claim 16, wherein the ink supply port is tubular, and the seal material is thermally adhered to a peripheral portion of the ink supply port.

28. The ink cartridge as claimed in claim 16, wherein the seal material is constructed by at least one light-transmissible film.

29. The ink cartridge as claimed in claim 16, wherein the seal material has a layered construction of at least a physical protective layer and an airtight hold layer.

30. The ink cartridge as claimed in claim 16, wherein the ink passage open/close section includes a valve body that is constantly urged by an elastic member to the ink supply port to close a flow passage and that is retreated as the ink introduction member is advanced to open the flow passage.

31. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port;

a seal material sealing the ink supply port; and a breakage induction part provided to the seal material or a proximity of the ink supply port, wherein the ink cartridge is packaged by an air shield film to maintain a pressure-reduced state, and wherein said seal material maintains said sealing of the ink supply port in said pressure-reduced state.

32. The ink cartridge as claimed in claim 31, wherein the ink supply port projects externally from a wall of the container, and the air shield film is closely contacted with the seal material using the atmospheric pressure to press the seal material toward the ink supply port.

33. The ink cartridge as claimed in claim 31, wherein the air shield film has a light transmission property at least in an area where the ink supply port is located.

34. An ink cartridge comprising:

a container storing ink therein;

an ink supply port into which an ink introduction member communicating with a record head is to be inserted;

an ink passage open/close section that is opened and closed as the ink introduction member is advanced and retreated to and from the ink supply port; and a seal material that seals the ink supply port and that has a cup-shaped convex part to fill a space of the ink supply port, whereby upon insertion of the ink introduction member there is a reduced chance of air entering into the ink introduction member.

35. The ink cartridge as claimed in claim 34, wherein the convex part is contacted with an inner peripheral surface of a packing attached to the ink supply port.

36. The ink cartridge as claimed in claim 35, wherein a clearance is formed between a distal end of the convex part and the packing.

37. An ink cartridge comprising:

a container divided into a plurality of chambers by a partition wall or partition walls;

a plurality of ink supply ports that communicate respectively with the chambers, and that are arranged on a single line;

a single seal material that seals the ink supply ports and that has at least one breakage induction member extending in a direction in which the ink supply ports are arranged, wherein said breakage induction member comprises a recess that does not extend completely through the thickness of said single seal material.

38. The ink cartridge as claimed in claim 37, wherein the seal material has a layered construction of at least a physical protective layer and an airtight hold layer.

39. The ink cartridge as claimed in claim 14, 29 or 37, wherein the airtight hold layer is formed by at least one film that is made of a polymeric material the same as or similar in group to a polymeric material forming the container.

40. A recorder comprising:

a record head; and an ink introduction member having an ink introduction port communicating with the record head so that ink is supplied from an ink cartridge through the ink introduction member to the record head, wherein a side surface of the ink introduction member is formed with an air flow-out groove that extends to a more distal side than the ink introduction port, whereby upon insertion of the ink introduction member into the cartridge there is a reduced chance of air entering into said ink introduction port, and further wherein after the ink introduction member breaks a seal material sealing an ink supply port of the ink cartridge, ink in the ink cartridge is permitted to flow into the record head through the introduction member.

41. A recorder comprising:

a record head; and an ink introduction member having an ink introduction port communicating with the record head so that ink is supplied from an ink cartridge through the ink introduction member to the record head, wherein the ink introduction member is provided, at a more distal side than the ink introduction port, with a sharp-pointed part for breaking the seal material, whereby upon insertion of the ink introduction member into the cartridge there is a reduced chance of air entering into said ink introduction port, and further wherein after the ink introduction member breaks a seal material sealing an ink supply port of the ink cartridge, ink in the ink cartridge is permitted to flow into the record head through the introduction member.

42. A recorder comprising:

a record head; and an ink introduction member having an ink introduction port communicating with the record head so that ink is supplied from an ink cartridge through the ink introduction member to the record head, wherein after the ink introduction member breaks a seal material sealing an ink supply port of the ink cartridge, ink in the ink cartridge is permitted to flow into the record head through the introduction member, and further wherein the seal material is formed with a breakage induction part by discontinuously changing a thickness of the seal material in a proximity of an area where the ink introduction member abuts, and a distal end of the ink introduction member is formed with a flat part, whereby upon insertion of the ink introduction member into the ink cartridge there is a reduced chance of air entering into said ink introduction port.

43. A recorder comprising:

a record head; and an ink introduction member having an ink introduction port communicating with the record head so that ink is supplied from an ink cartridge through the ink introduction member to the record head, wherein after the ink introduction member breaks a seal material sealing an ink supply port of the ink cartridge, ink in the ink cartridge is permitted to flow into the record head through the introduction member, and further wherein a projection for preliminarily breaking the seal material is formed on a housing of the recorder, whereby the seal material may be broken in such a manner as to reduce the amount of air entering the ink introduction port when the ink introduction member is inserted into the cartridge.

44. A method of mounting an ink cartridge for connection to an ink introduction member communicating with a record head, the ink cartridge comprising an ink chamber storing ink therein, a ventilation hole communicating the ink chamber with atmosphere, an ink supply port communicated with the ink chamber via a filter, an ink passage open/close section disposed between the ink supply port and the ink chamber, and a seal material sealing the ink supply port, the ink cartridge being packaged by a pressure-reduced packing material, wherein the seal material maintains sealing of the ink supply port when the ink cartridge is in the pressure-reduced packaging material, the method comprising the steps of:

taking out the ink cartridge from the pressure-reduced packing material;

breaking the seal material to release a space between the seal material and the ink passage open/close section to the atmosphere; and opening the ink passage open/close section to communicate the ink chamber with the record head.

45. The method as claimed in claim 44, wherein the step of breaking is performed before or after the ventilation hole is released to the atmosphere.

46. An ink cartridge comprising:

a container having a chamber storing ink therein;

an ink supply port communicatable with the chamber;

a packing member disposed in the ink supply port, and having an interior surface at least partly tapered;

an ink passage open/close section disposed in the ink supply port and between the chamber and the packing member; and a seal material that seals the ink supply port and that has a cup-shaped convex part substantially extending along the interior surface of the packing member.

* * * * *